US012497839B2

(12) United States Patent
Tao et al.

(10) Patent No.: US 12,497,839 B2
(45) Date of Patent: Dec. 16, 2025

(54) BIOINSPIRED HORIZONTAL SELF-BURROWING DEVICE

(71) Applicants: Junliang Tao, Chandler, AZ (US); Sichuan Huang, Tempe, AZ (US); Yong Tang, Tempe, AZ (US); Yi Zhong, Tempe, AZ (US)

(72) Inventors: Junliang Tao, Chandler, AZ (US); Sichuan Huang, Tempe, AZ (US); Yong Tang, Tempe, AZ (US); Yi Zhong, Tempe, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 0 days.

(21) Appl. No.: 18/409,006

(22) Filed: Jan. 10, 2024

(65) Prior Publication Data

US 2024/0254839 A1 Aug. 1, 2024

Related U.S. Application Data

(60) Provisional application No. 63/479,208, filed on Jan. 10, 2023.

(51) Int. Cl.
*E21B 7/26* (2006.01)

(52) U.S. Cl.
CPC ..... *E21B 7/26* (2013.01)

(58) Field of Classification Search
CPC ..... E21B 7/26
See application file for complete search history.

(56) References Cited

U.S. PATENT DOCUMENTS

2006/0096769 A1* 5/2006 Randa ..... E21B 7/26 173/91
2009/0188137 A1* 7/2009 Yasuda ..... E21B 44/04 37/195

(Continued)

OTHER PUBLICATIONS

Cundall, P. A., et al., "A discrete numerical model for granular assemblies." Géotechnique. 29 (1979) (1): 47-65. https://doi.org/10.1680/geot.1979.29.1.47.

(Continued)

*Primary Examiner* — Nicole Coy
*Assistant Examiner* — Jennifer A Railey
(74) *Attorney, Agent, or Firm* — Snell & Wilmer L.L.P.

(57) ABSTRACT

A burrowing apparatus may comprise an anterior segment and a posterior segment coupled by a linear actuator that is configured to extend and contract the distance between the anterior segment and the posterior segment to effectuate horizontal translation of the burrowing apparatus in a granular medium. The anterior segment may further comprise a conical tip. The conical tip may be configured to rotate relative to the anterior segment, and the conical tip may be an auger. The rotation of the conical tip while the linear actuator extends and contracts may create kinetic asymmetry that may be beneficial to the net horizontal translation in the granular medium. The burrowing apparatus may be advantageously used in applications, for example, in geotechnical subsurface investigation, extraterrestrial exploration, underground contamination detection, and precision agriculture.

20 Claims, 22 Drawing Sheets

(56) References Cited

U.S. PATENT DOCUMENTS

2015/0338301 A1* 11/2015 Freyer ..... G01L 11/00 73/756
2021/0025128 A1* 1/2021 Hemmati ..... E02F 3/06

OTHER PUBLICATIONS

Ding, Y., et al., "Drag Induced Lift in Granular Media." Physical Review Letters, 106 (2011) (2): 028001. https://doi.org/10.1103/PhysRevLett.106. 028001.
Dorgan, K. M. et al., "Burrow extension by crack propagation." Nature, 433 (2005) (7025): 475-475. https: //doi.org/10.1038/433475a.
Fang, L., et al., "Chrono::GPU: An Open-Source Simulation Package for Granular Dynamics Using the Discrete Element Method." Processes, 9 (2021) (10): 1813. https://doi.org/10.3390/pr9101813.
Härtl, J., et al., "Experiments and simulations of direct shear tests: Porosity, contact friction and bulk friction." Granular Matter, 10 (2008) (4): 263-271. https://doi.org/10.1007/s10035-008-0085-3.
Hosoi, A. E., et al., "Beneath Our Feet: Strategies for Locomotion in Granular Media." Annu. Rev. Fluid Mech., 47 (2015) (1): 431-453. https://doi.org/10.1 146/annurev-fluid-010313-141324.
Huang, S., et al., "Effects of Friction Anisotropy on Upward Burrowing Behavior of Soft Robots in Granular Materials." Advanced Intelligent Systems, 2 (2020) (6): 1900183. https://doi.org/10.1002/aisy.201900183.
Huang, S., et al., "Bioinspired Horizontal Self-Burrowing Robot." Geo-Congress. Charlotte, North Carolina: American Society of Civil Engineers. 2022, (2022) 223-231.
Lommen, S., et al., "Co-simulation framework of discrete element method and multibody dynamics models." Engineering Computations, 35 (2018) (3): 1481-1499. https://doi.org/10.1108/EC-07-2017-0246.
Maladen, R. D., et al., "Undulatory Swimming in Sand: Subsurface Locomotion of the Sandfish Lizard." Science, 325 (2009) (5938): 314-318. https://doi.org/10.1126/science.1172490.
Maladen, R. D., et al., "Granular lift forces predict vertical motion of a sand-swimming robot." 2011 IEEE International Conference on Robotics and Automation, (2011) 1398-1403.
Montana, J., et al., "Liquid sand burrowing and mucus utilisation as novel adaptations to a structurally-simple environment in Octopus Kaurna Stranks, 1990." Behaviour, 152 (2015) (14): 1871-1881. https://doi.org/10.1163/15 68539X-00003313.
Naclerio, N. D., et al., "Controlling subterranean forces enables a fast, steerable, burrowing soft robot." Science Robotics, 6 (2021) (55): eabe2922. https://doi.org/10.1126/scirobotics.abe2922.
Purcell, E. M. "Life at low Reynolds number." American Journal of Physics, 45 (1977) (1): 3-11. https://doi.org/10.1119/1.10903.
Tang, Y., et al., "Multiscale analysis of rotational penetration in shallow dry sand and implications for self-burrowing robot design." Acta Geotechnica. (2022) https://doi.org/10.1007/s11440-022-01492-x.
Thoesen, A., et al., "Screw-generated forces in granular media: Experimental, computational, and analytical comparison." AIChE Journal, 65 (2019) (3): 894-903. https://doi.org/10.1002/aic.16517.
Winter, A. G., et al., "Razor clam to RoboClam: Burrowing drag reduction mechanisms and their robotic adaptation." Bioinspiration & Biomimetics, 9 (2014) (3): 036009. https: //doi.org/10.1088/1748-3182/9/3/036009.
Abraham, Y, et al., Hygroscopic movements in Geraniaceae: the structural variations that are responsible for coiling or bending. New Phytol (2013) 199: 584-594. https://doi.org/10. 1111/nph.12254.
Abraham, Y, et al., Tilted cellulose arrangement as a novel mechanism for hygroscopic coiling in the stork's bill awn. J R Soc Interface (2012) 9:640-647. https://doi.org/10.1098/rsif.2011.0395.
Ansell, A.D, et al., Burrowing in *Mercenaria mercenaria* (L.) (Bivalvia, Veneridae). J Exp Biol (1967) 46:105-115. https://doi.org/10.1242/jeb.46.1.105.
Arroyo, M, et al., Cone penetration tests in a virtual calibration chamber. Geotechnique (2011) 61:525-531. https://doi.org/10.1680/geot.9.P.067.
Belheine, N, et al. Numerical simulation of drained triaxial test using 3D discrete element modeling. Comput Geotech (2009) 36:320-331. https://doi.org/10.1016/j.compgeo.2008.02.003.
Bengough, A.G, et al., Estimating soil frictional resistance to metal probes and its relevance to the penetration of soil by roots. Eur J Soil Sci (1997) 48:603-612. https://doi.org/10.1111/j.1365-2389.1997.tb00560.x.
Borela, R, et al., Earthworm-inspired robotic locomotion in sand: an experimental study with X-ray tomography. Geotechnique Lett (2021) 11:66-73. https://doi.org/10.1680/jgele.20.00085.
Butlanska, J, et al., Size effects on a virtual calibration chamber. In: Numerical methods in geotechnical engineering. CRC Press, Hoboken (2010).
Chen, Y, et al., Modeling the self-penetration process of a bio-inspired probe in granular soils. Bioinspiration & biomimetics (2021) 16:046012. https://doi.org/10.1088/1748-3190/abf46e.
Chen, RP, et al., Face stability analysis of shallow shield tunnels in dry sandy ground using the discrete element method. Comput Geotech (2011) 38:187-195. https://doi.org/10.1016/j.compgeo.2010.11.003.
Ciantia, MO, et al., Pile penetration in crushable soils: insights from micromechanical modelling. In: Proceedings of the XVII ECSMGE-2019 (2019) 5247-5266. https://doi.org/10.32075/17ECSMGE-2019-1111.
Cui, L, et al., Exploring the macro- and micro-scale response of an idealised granular material in the direct shear apparatus. Geotechnique (2006) 56:455-468. https://doi.org/10.1680/geot.56.7.455.
Darbois Texier, B, et al., Helical locomotion in a granular medium. Phys Rev Lett (2017) 119:068003. https://doi.org/10. 1103/PhysRevLett.119.068003.
Dorgan, KM, The biomechanics of burrowing and boring. J Exp Biol (2015) 218:176-183. https://doi.org/10.1242/jeb.086983.
Del Dottore, E, et al., An efficient soil penetration strategy for explorative robots inspired by plant root circumnutation movements. Bioinspir Biomim (2017) 13:015003. https://doi.org/10.1088/1748-3190/aa9998.
Elbaum, R, et al., Insights into the microstructures of hygroscopic movement in plant seed dispersal. Plant Sci (2014) 223:124-133. https://doi.org/10.1016/j.plantsci.2014.03.014.
Elbaum R, et al., Structures in the cell wall that enable hygroscopic movement of wheat awns. J Struct Biol (2008) 164:101-107. https://doi.org/10.1016/j.jsb.2008.06.008.
Elbaum, R, et al., The role of wheat awns in the seed dispersal unit. Science (2007) 316 (5826):884-886. https://doi.org/10.1126/science.1140097.
Evangelista, D, et al., The mechanics of explosive dispersal and self-burial in the seeds of the filaree, Erodium cicutarium (Geraniaceae). J Exp Biol (2011) 214:521-529. https://doi.org/10.1242/jeb.050567.
Jet Propulsion Labortory, A. Good et al., NASA's mars InSight lander to push on top of the 'mole'. (2020) http://www.nasa.gov/feature/jpl/nasas-mars-insight-lander-to-push-on-top-of-the-mole.
Gu, M, et al., Three-dimensional discrete-element method analysis of stresses and deformations of a single geogrid encased stone col. Int J Geomech (2017) 17:04017070. https://doi. org/10.1061/(ASCE)GM.1943-5622.0000952.
Huang, S, et al., Modeling clam-inspired burrowing in dry sand using cavity expansion theory and DEM. Acta Geotech (2020) 15:2305-2326. https://doi.org/10.1007/s11440-020-00918-8.
Jerier, J-F, et al., A geometric algorithm based on tetrahedral meshes to generate a dense polydisperse sphere packing. Granul Matter (2009) 11:43-52. https://doi.org/10.1007/s10035-008-0116-0.
Jiang, M, et al., Investigating mechanism of inclined CPT in granular ground using DEM. Granul Matter (2014) 16:785-796. https://doi.org/10.1007/s10035-014-0508-2.
Jing, X-Y, et al., Analysis of soil-structural interface behavior using three-dimensional DEM simulations. Int J Numer Anal Meth Geomech (2018) 42:339-357. https://doi.org/10.1002/nag.2745.
Jung, W, et al., Reduction of granular drag inspired by self-burrowing rotary seeds. Phys Fluids (2017) 29:041702. https://doi.org/10.1063/1.4979998.

(56) References Cited

OTHER PUBLICATIONS

Jung, W, et al., Self-burial mechanics of hygroscopically responsive awns. Integr Comp Biol (2014) 54:1034-1042. https://doi.org/10.1093/icb/icu026.
Kang, C, et al., (2018) Numerical simulation of 2D granular flow entrainment using DEM. Granul Matter 20:13. https://doi. org/10.1007/s10035-017-0782-x.
Khosravi, A, et al., Discrete element model (DEM) simulations of cone penetration test (CPT) measurements and soil classification. Can Geotech J (2020) 57:1369-1387. https://doi.org/10.1139/cgj-2019-0512.
Li, L, et al., DEM analysis of the sand plug behavior during the installation process of open-ended pile. Comput Geotech (2019) 109:23-33. https://doi.org/10.1016/j.compgeo.2019.01.014.
Lu, Y, et al., Three-dimensional DEM modeling of triaxial compression of sands. In: Soil behavior and geo-micromechanics. American Society of Civil Engineers, Shanghai, China, (2010) pp. 220-226.
Ma, Y, et al., 2D Dem analysis of the interactions between bio-inspired geo-probe and soil during inflation-deflation cycles. Granul Matter (2020) 22:11. https://doi.org/10.1007/s10035-019-0974-7.
Maladen, R.D., et al., Mechanical models of sandfish locomotion reveal principles of high performance subsurface sand-swimming. J R Soc Interface. 1332-1345 (2011) https://doi.org/10.1098/rsif.2010.0678.
Martinez, A, et al., Bio-inspired geotechnical engineering: principles, current work, opportunities, and challenges. Géotechnique. (2021) 8(62), https://doi.org/10.1680/jgeot.20. P.170.
Mazzolai, B, et al., Can a robot grow? Plants give US the answer. In: Bioinspiration, Biomimetics, and Bioreplication 2017. SPIE, (2017) pp. 24-33.
Migliaccio, F, et al., Circumnutation as an autonomous root movement in plants. Am J Bot (2013) 100:4-13. https://doi.org/10.3732/ajb.1200314.
Minh, NH, et al., Strong force networks in granular mixtures. Granul Matter (2014) 16:69-78. https://doi.org/10. 1007/s10035-013-0455-3.
Naclerio, ND, et al., Soft robotic burrowing device with tip-extension and granular fluidization. In: 2018 IEEE/RSJ international conference on intelligent robots and systems (IROS), (2018) pp. 5918-5923.
Plassiard, J-P et al., Calibration procedure for spherical discrete elements using a local moment law, (2007) pp. 8.
Quillin, KJ, Ontogenetic scaling of burrowing forces in the earthworm Lumbricus terrestris. J Exp Biol (2000) 203:2757-2770. https://doi.org/10.1242/jeb.203.18.2757.
Sadeghi, A, et al., A novel growing device inspired by plant root soil penetration behaviors. PLoS One (2014) 9:e90139. https://doi.org/10.1371/journal.pone. 0090139.
Sharif, Yu, et al., Using discrete element method (DEM) to create a cone penetration test (CPT)-based method to estimate the installation requirements of rotary-installed piles in sand. Can Geotech J (2021) 58:919-935. https://doi.org/10.1139/cgj-2020-0017.
Shi, D, et al., DEM modelling of screw pile penetration in loose granular assemblies considering the effect of drilling velocity ratio. Granul Matter (2019) 21:74. https://doi.org/10.1007/s10035-019-0933-3.
Smilauer, V, et al., Yade. Documentation. (2021) https://doi.org/10.5281/ZENODO.5705394.
Stamp, NE, Self-burial behaviour of Erodium cicutarium seeds. J Ecol (1984) 72:611-620. https://doi.org/10.2307/2260070.
Steendam, C, et al., Burrowing behaviour of the European eel (*Anguilla anguilla*): effects of life stage. J Fish Biol (2020) 97:1332-1342. https://doi.org/10.1111/jfb.14481.
Tang, Y, et al., Effect of rotation on seeds' selfburial process: insights from DEM simulations. In: Geo-Congress 2020. American Society of Civil Engineers, Minneapolis, Minnesota, (2020) pp. 293-301.
Tao, J, Burrowing soft robots break new ground. Sci Robot—(2021) 6:3615. https://doi.org/10.1126/scirobotics.abj3615.
Tao, J. J., et al., SBOR: a minimalistic soft self-burrowing-out robot inspired by razor clams. Bioinspiration & biomimetics (2020) 15:055003. https://doi.org/10.1088/1748-3190/ab8754.
Trueman, E., The mechanism of burrowing in the polychaete worm, *Arenicola marina* (L.). Biol Bull (1966) 131:369-377. https://doi.org/10.2307/1539763.
Trueman, E., et al., The dynamics of burrowing of some common littoral bivalves. J Exp Biol (1966) 44:469-492. https://doi.org/10.1242/jeb.44.3.469.
Trueman, E., et al., The dynamics of burrowing in Ensis (Bivalvia). Proc R Soc Lond B (1966) 166 (1005):459-476. https://doi. org/10.1098/rspb.1967.0007.
Wensrich, CM, et al., Characterisation of the effects of particle shape using a normalised contact eccentricity. Granul Matter (2014) 16:327-337. https://doi.org/10.1007/s10035-013-0465-1.
Yang, P, et al., 3D Dem simulations of drained triaxial compression of sand strengthened using microbially induced carbonate precipitation. Int J Geomech (2017) 17:04016143. https://doi.org/10.1061/(ASCE)GM.1943-5622.0000848.
Zhong, W, et al. Investigation of the penetration characteristics of snake skin-inspired pile using DEM. Acta Geotech (2021) 16:1849-1865. https://doi.org/10.1007/s11440-020-01132-2.
Zhou, W, et al., DEM modeling of shear bands in crushable and irregularly shaped granular materials. Granul Matter (2017) 19:25. https://doi.org/10.1007/s10035-017-0712-y.
Abdalla, A., et al., "The mechanics of root growth in granular media." Journal of Agricultural Engineering Research, (1969) 14(3), 236-248.
Bradski, G., et al., "The OpenCV Library" Dr. Dobb's journal of software tools, (2000).
Guillard, F., et al., "Lift forces in granular media." Physics of Fluids, (2014) 26(4), 043301.
Huang, S., et al., "Force-chain evolution in granular packings under a razor-clam inspired penetration." Bulletin of the American Physical Society. (2021).
Lucas, B. D., et al. "An iterative image registration technique with an application to stereo vision." Vancouver, British Columbia.
Maladen, R. D., et al., "Undulatory swimming in sand: experimental and simulation studies of a robotic sandfish." The International Journal of Robotics Research, (2011) 30(7), 793-805.
Oritz, D., et al., "Soft Robot Actuation Strategies for Locomotion in Granular Substrates." IEEE Robotics and Automation Letters, (2019) 4(3), 2630-2636.
Pitcher, C., et al., "Analysis of drill head designs for dual-reciprocating drilling technique in planetary regoliths." Advances in Space Research, (2015) 56(8), 1765-1776.
Sharpe, S. S., et al., "Locomotor benefits of being a slender and slick sand swimmer." Journal of Experimental Biology, (2015) 218(3), 440-450.
Tang, Y., et al., "Effect of Rotation on Penetration: Toward a Seed Awn-Inspired Self- Burrowing Probe." IFCEE (2021) 2021, 149-159.
Tao, J. J., et al., "Bioinspired Self-Burrowing-Out Robot in Dry Sand." Journal of Geotechnical and Geoenvironmental Engineering, (2019) 145(12), 02819002.
Badanagki M (2020) Centrifuge modeling of dense granular cols. in layered liquefiable soils with varying stratigraphy and overlying structures. In: PhD thesis, University of Colorado at Boulder.
Vasko A (2020) An investigation into the behavior of ottawa sand through monotonic and cyclic shear tests. M.S., The George Washington University.
Butlanska J (2014) Cone penetration test in a virtual calibration chamber. In: TDX (Tesis Doctorals en Xarxa).

* cited by examiner

BIOINSPIRED HORIZONTAL SELF-BURROWING DEVICE

CROSS-REFERENCE TO RELATED APPLICATIONS

This application claims priority to, and the benefit of, U.S. Provisional Patent Application Ser. No. 63/479,208 filed Jan. 10, 2023 entitled "BIOINSPIRED HORIZONTAL SELF-BURROWING ROBOT." The foregoing application is hereby incorporated by reference in its entirety for all purposes, including but not limited to those portions that specifically appear hereinafter, but except for any subject matter disclaimers or disavowals, and except to the extent that the incorporated material is inconsistent with the express disclosure herein, in which case the language in this disclosure shall control.

FEDERALLY SPONSORED RESEARCH OR DEVELOPMENT

This invention was made with government support under 1849674 and 1841574 awarded by the National Science Foundation. The government has certain rights in the invention.

TECHNICAL FIELD

The present disclosure relates to robotic systems, and in particular to mechanisms for use in connection with burrowing in granular media.

SUMMARY

A robot for burrowing horizontally a granular medium, such as soil, is disclosed. The robot comprises an anterior segment, and a posterior segment coupled to the anterior segment by a micro linear actuator so as to allow to expand and contract the space between the anterior segment and posterior segment.

In various embodiments, the anterior segment has a conical tip coupled to it. In various embodiments, one side of the anterior segment is coupled to the posterior segment and the opposite side of the anterior segment is coupled to the conical tip. In various embodiments, the anterior segment is coupled to the conical tip by a gear motor. In various embodiments, the gear motor rotates the conical tip when the distance between the anterior segment and posterior segment is expanding to increase the efficiency of the horizontal movement in the granular medium. In various embodiments, the conical tip is threaded to create a screw tip. In other embodiments, the conical tip is an auger instead of a smooth cone. In various embodiments, the movement of the linear actuator and the gear motor are controlled with a microcontroller.

In various embodiments, the connection between the posterior segment and the anterior segment is encased in a silicone tube. In various embodiments, the micro linear actuator is housed in an actuator casing. In various embodiments the gear motor is a micro gear motor. In various embodiments the gear motor is housed in a motor case. In various embodiments the cross sections of the anterior segment and the posterior segment are round. In various embodiments the cross sections of the anterior segment and the posterior segment are square.

A method for burrowing in a granular medium with a burrowing device is disclosed, comprising extending the distance between an anterior segment of the burrowing device and a posterior segment of the burrowing device with a linear actuator.

In various embodiments, the method further comprises rotating a conical tip that is coupled to the anterior segment relative to the anterior segment. In various embodiments, the method further comprises rotating a threaded conical tip that is coupled to the anterior segment relative to the anterior segment. In various embodiments, the method further comprises rotating an auger tip that is coupled to the anterior segment relative to the anterior segment.

The foregoing features, elements, steps, or methods may be combined in various combinations without exclusivity, unless expressly indicated herein otherwise. These features, elements, steps, or methods as well as the operation of the disclosed embodiments will become more apparent in light of the following description and accompanying drawings.

BRIEF DESCRIPTION OF THE DRAWINGS

With reference to the following description and accompanying drawings:

FIGS. 11A and 11B illustrate graphical representations of the impact of overburden pressure and extension rate on burrowing performance of a burrowing device, wherein FIG. 11A shows the moving trajectory of a first marker monitored in the T-slot track experiment for different configurations of overburden pressures and extension rates, and FIG. 11B shows the advancement and slip in each burrowing cycle for each of five configurations of burrowing devices, in accordance with an exemplary embodiment;

FIGS. 12A and 12B illustrate graphical representations of the impact of overburden pressure and extension rate on burrowing performance of a burrowing device, wherein FIG. 12A shows the stride length of each extension-contraction cycle for different configurations of overburden pressures and extension rates as a function of the number of extension-contraction cycles, and FIG. 12B shows the inclination of the mast in each test for different configurations of overburden pressures and extension rates of burrowing devices as a function of time, in accordance with an exemplary embodiment;

DETAILED DESCRIPTION

Figure 1:
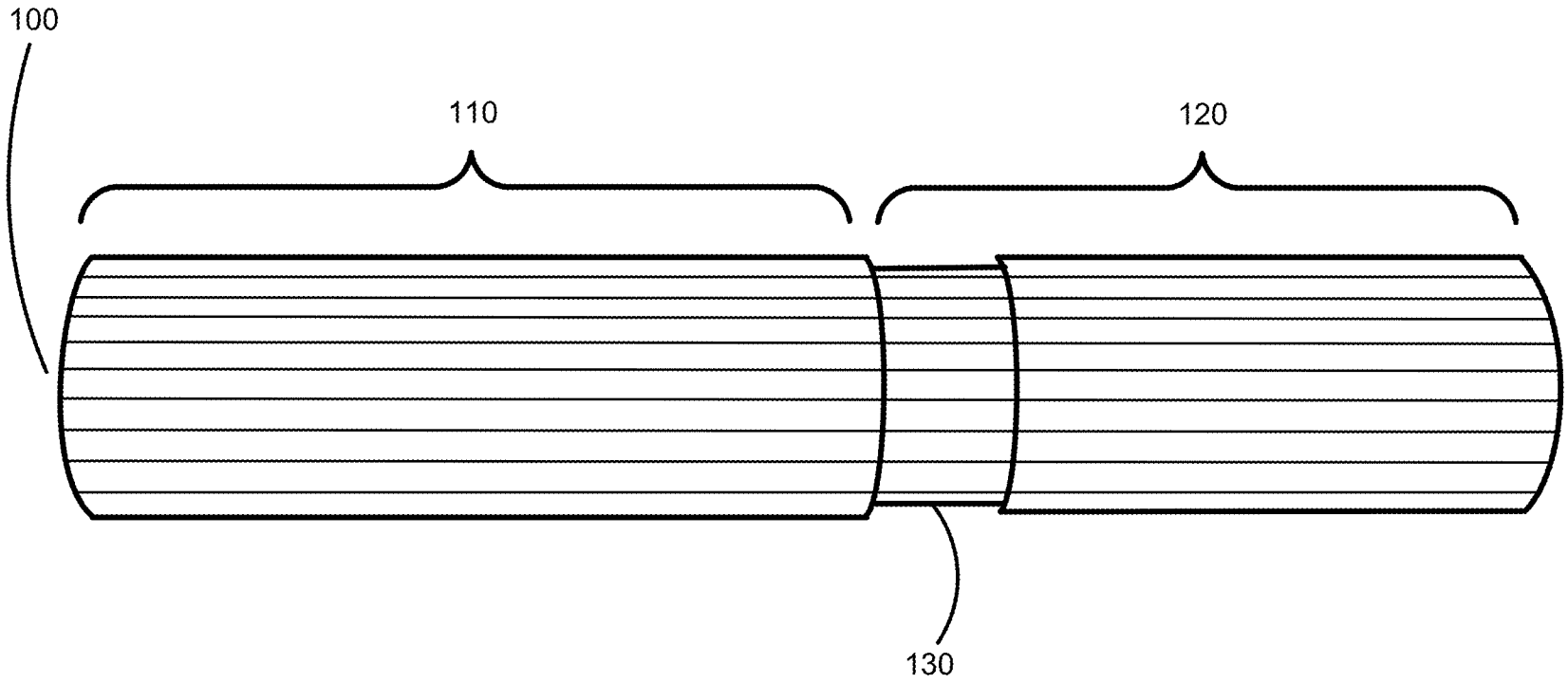
FIG. 1 illustrates a burrowing device including two cylindrical segments coupled by a linear actuator, in accordance with various exemplary embodiments.

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from principles of the present disclosure.

For the sake of brevity, conventional techniques and components for robotic systems may not be described in detail herein. Furthermore, the connecting lines shown in various figures contained herein are intended to represent exemplary functional relationships and/or physical couplings between various elements. It should be noted that many alternative or additional functional relationships or physical connections may be present in exemplary extensible robotic systems and/or components thereof.

Mechanical movement in soil or other granular mediums can be difficult, especially with increasing depth under the surface. This is due to soil's high strength and the increasing soil effective stress and strength invoked by the intrinsic gravitational field as the depth increases. Some biological organisms have the capabilities to burrow using well-evolved locomotion strategies. For example, razor clams use a dual-anchor strategy, snakes and lizards use body undulation, while some worms use peristalsis, and some plant roots alternate their growth directions. Further, many organisms reduce the burrowing force by manipulating soil. Examples include a worm lizard, which rotates its head to reduce the forces during burrowing. These methods used in nature inform principles of the present disclosure. The resultant burrowing device can be used for geotechnical subsurface investigation, extraterrestrial exploration, underground contamination detection, and precision agriculture, among various other applications and benefits. Moreover, methods for testing burrowing devices to determine optimal mechanical conditions and characteristics in a given medium are disclosed herein.

Most burrowing devices that borrow from the kinematics used by burrowing biological organisms require complex designs and external support from the surface. The present disclosure provides for a self-contained, minimalist design in a burrowing device, with fewer moving parts and a fully integrated system. A burrowing device disclosed implements a simple kinematic control strategy to efficiently move horizontally when surrounded by a granular medium, which may be sand or soil, or a fluid medium. The body of the burrowing device comprises two segments, which are coupled by a micro linear actuator that expands and contracts the distance between the two segments when activated. The speed of the expansion and contraction may be modulated to increase or decrease the speed of the burrowing. Burrowing devices may be enabled to explore, complete search-and-rescue missions, deploy sensors, inspect, monitor, use for surveillance purposes, transportation, and for construction.

In various embodiments, a burrowing device may comprise two major segments: an anterior rotatable tip and an extensible body. The extensible body may comprise an anterior segment and a posterior segment, or a first segment and a second segment. The connection between the anterior segment and posterior segment may be covered by a corrugated soft tube, for example, made of DragonSkin-10. In various embodiments, the corrugated soft tube protects the connection from being invaded by particles or elements of the granular medium. In various embodiments, a silicone cover covers the connection between the posterior segment and the anterior segment to ensure that the particles of the granular medium do not enter the system and corrupt the movement of the extensible body. The anterior segment may comprise a gear motor that couples to the anterior tip to enable the rotation of the anterior tip. In various embodiments the anterior tip may be a conical tip. The anterior segment and posterior segment may be coupled by a linear actuator that is located in a cavity of the posterior segment. In various embodiments, the linear actuator may be a micro linear actuator.

The burrowing device disclosed may comprise a conical tip to decrease soil penetration resistance and increase the speed of horizontal displacement. The conical tip may be configured to rotate when the linear actuator of the burrowing device is being extended to further decrease soil penetration resistance. The restriction of the rotation of the conical tip to when the linear actuator is extending is to break the symmetry of kinematics and boundary conditions of the system and gain net horizontal displacement. The rotational velocity of the conical tip may be adjusted dependent on the desired horizontal velocity of the device. Increasing the rotational velocity of the conical tip will reduce the penetration resistance and thereby increase the burrowing speed.

The tip on the anterior segment of the burrowing device may resemble a screw or auger with threads. The addition of threads also increases the burrowing speed by adding additional thrusts and forward advancement via rotating the threaded or auger tip, and by anchoring the device to prevent backsliding while the linear actuator is contracting and the conical tip is stationary.

With reference to FIG. 1, a burrowing device 100 is illustrated in accordance with various embodiments. An anterior segment 110 may be cylindrical. A posterior segment 120 may be the same shape in cross section as the anterior segment 110, but include a coupling cylinder 130 that is a portion of the posterior segment that has a smaller diameter than the rest of the posterior segment. The outer diameter of the coupling cylinder 130 may be equivalent to the inner diameter of the anterior segment 110. The coupling cylinder 130 can slide in and out of the anterior segment to expand and contract the distance between the anterior segment 110 and the posterior segment 120. A linear actuating motor may be encased within the coupling cylinder 130 and the posterior segment 120 to activate the expansion and contraction of the distance between the anterior segment 110 and the posterior segment 120.

Figure 2A:
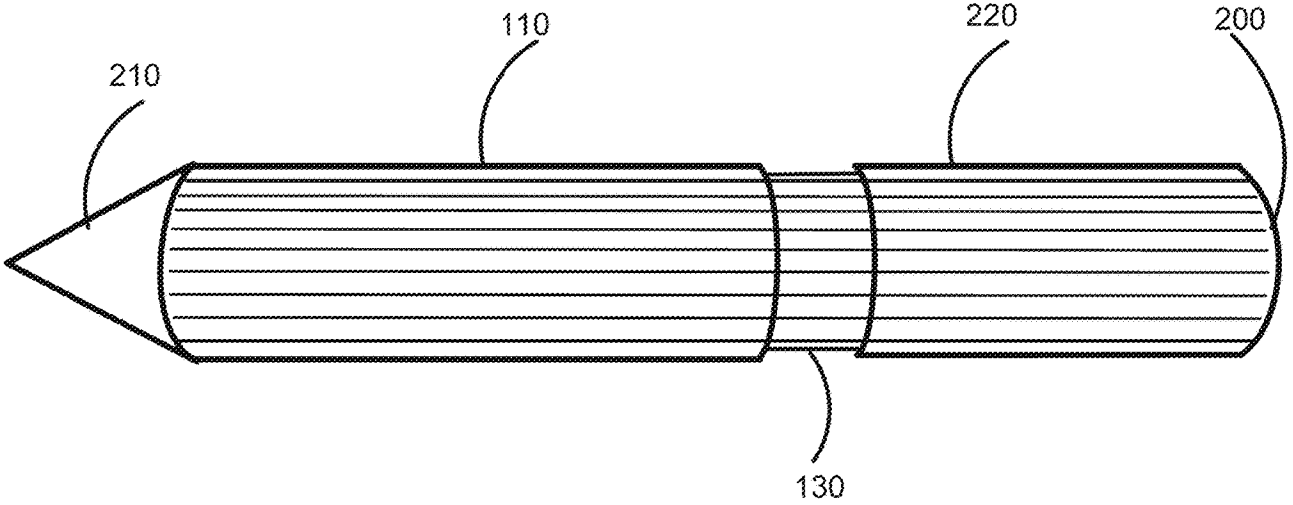
FIGS. 2A and 2B illustrate a burrowing device including a first conical tip coupled to the anterior segment and a second conical tip coupled to the posterior segment, in accordance with various exemplary embodiments.
Figure 2B:
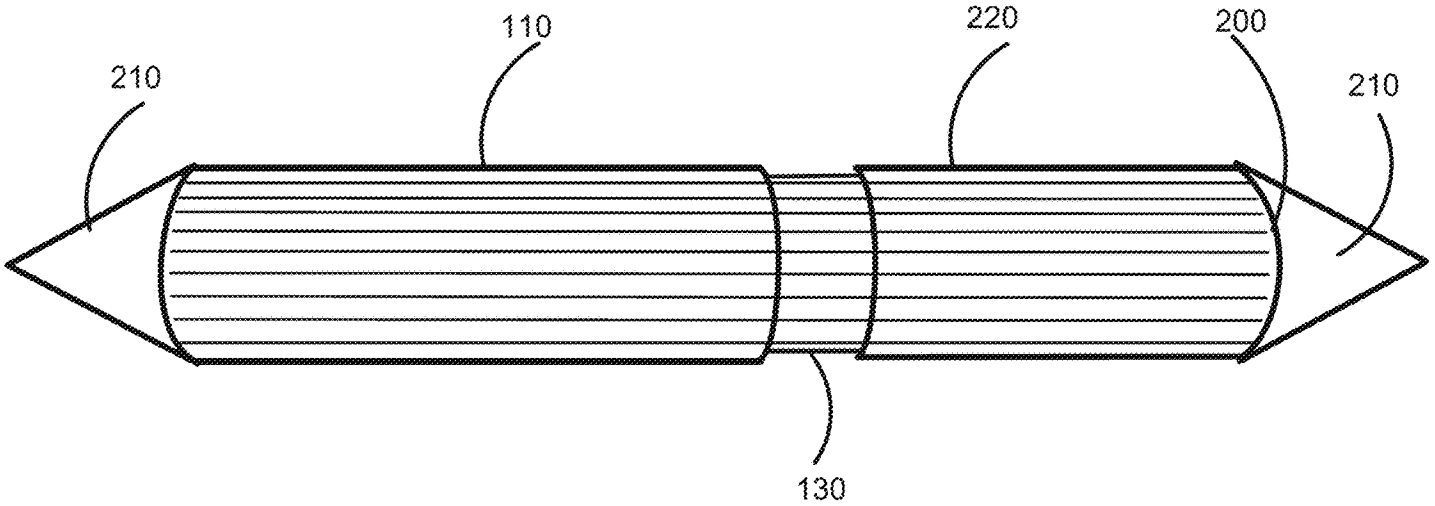

With reference to FIGS. 2A and 2B, exemplary burrowing device 200 may comprise a conical tip 210 coupled to the anterior segment 110. The conical tip 210 and the anterior segment 110 may encase a rotational motor coupled to the conical tip 210 to allow the conical tip to rotate relative to the anterior segment 110. The rotation of the conical tip activated by the rotational motor may increase the burrowing speed of the burrowing device by reducing the resistance of the granular medium. In various embodiments, the conical tip 210 may rotate relative to the anterior segment 110 when the linear actuator is expanding, and stop rotating when the linear actuator is contracting. With the configuration of tip rotation during extension only, the resistance of the granular medium in front of the burrowing device may be reduced during extension, and the resistance of the granular medium behind the posterior end of the burrowing device may be greater, leading to an increase in horizontal displacement, stride length, and burrowing speed.

Figure 3A:
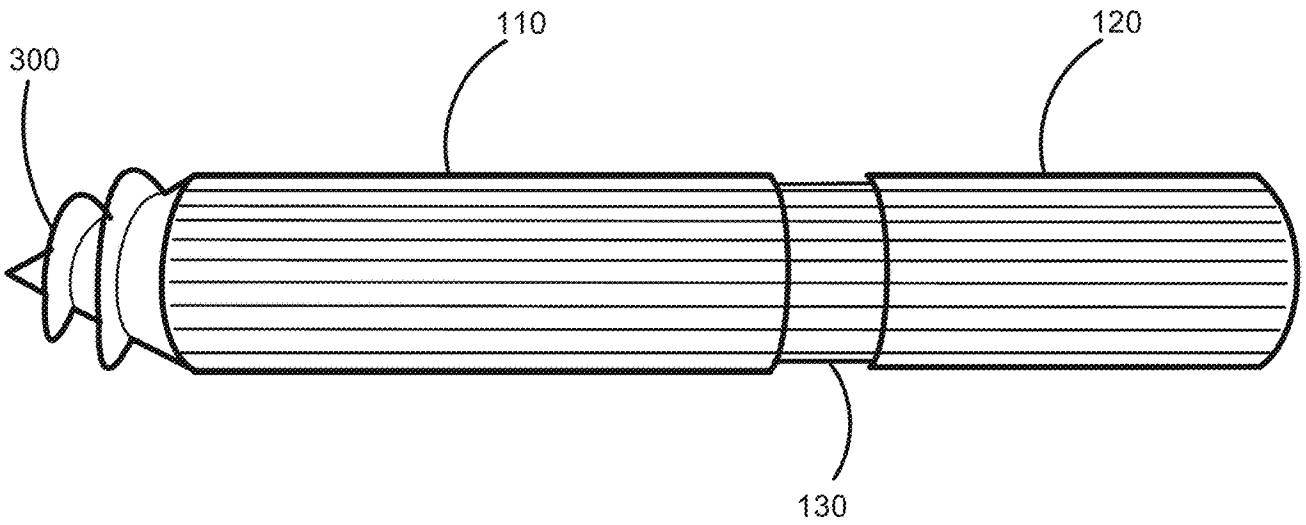
FIGS. 3A and 3B illustrate a burrowing device including threads on the conical tips, in accordance with various exemplary embodiments.
Figure 3B:
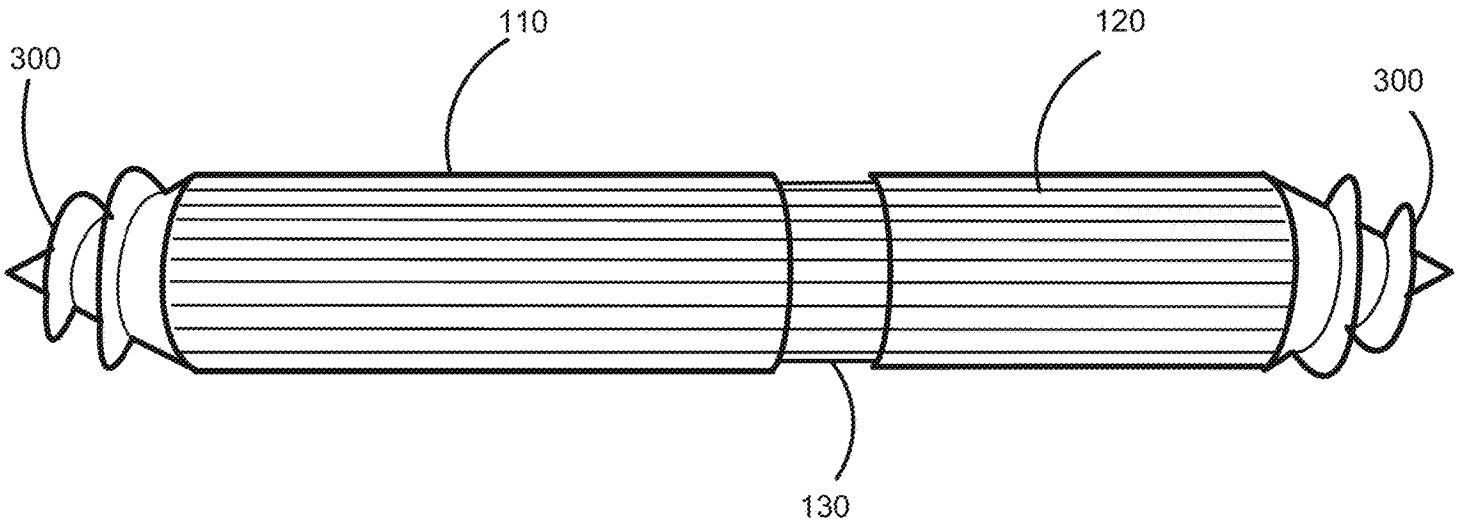

With reference to FIGS. 3A and 3B, an exemplary burrowing device may include a threaded conical tip 300 in place of the conical tip 210 of FIGS. 2A and 2B. In various embodiments, the threaded conical tip 300 may be an auger. This threaded conical tip may be coupled to the anterior segment 110 or the posterior segment 120. With specific reference to FIGS. 2B and 3B, there may also be a first conical tip and a second conical tip, wherein the first conical tip is coupled to the anterior segment 110 and the second conical tip is coupled to the posterior segment 120.

Figure 4:
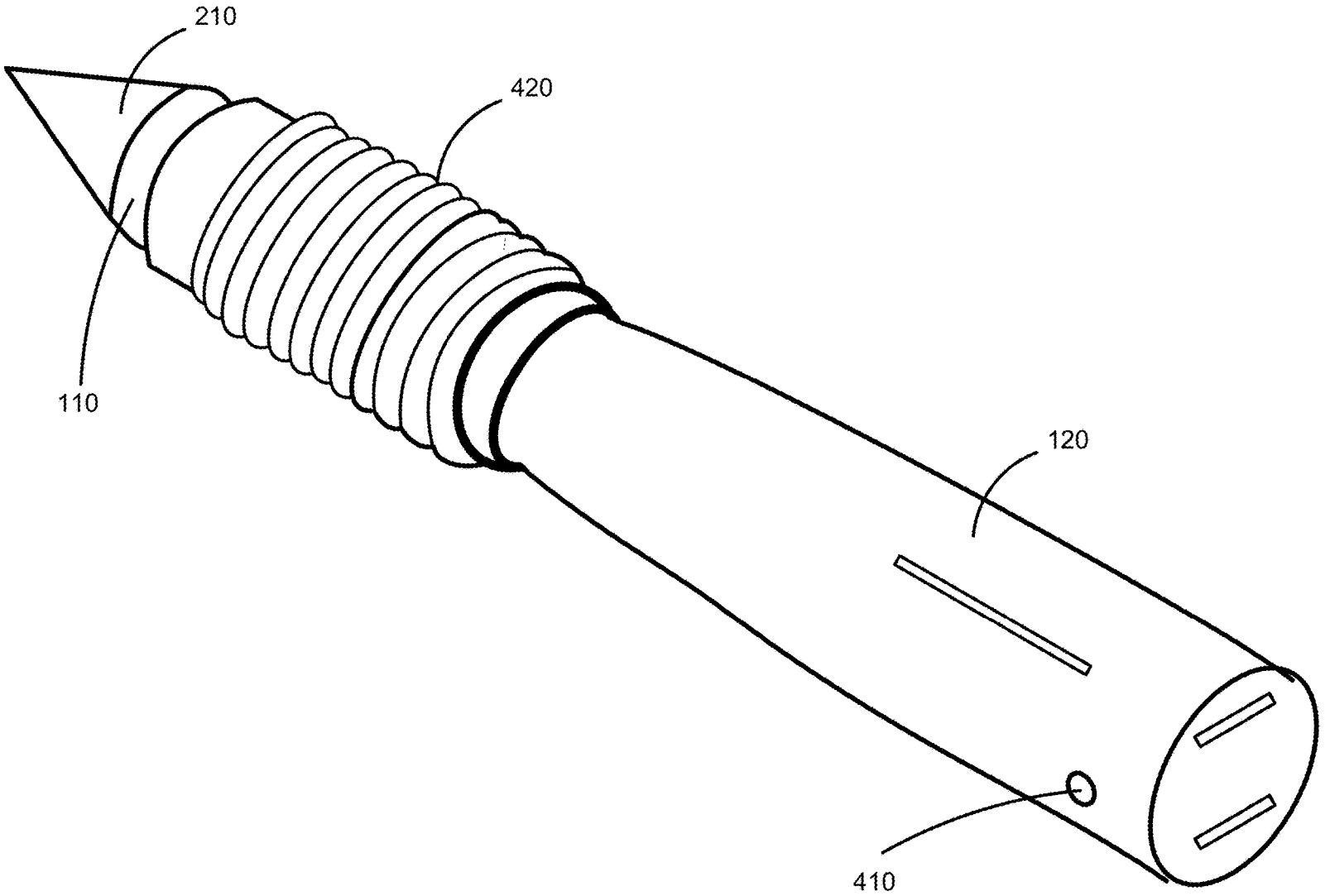
FIG. 4 illustrates a burrowing device including a conical tip, a silicone cover for the anterior segment, and motor casing, in accordance with various exemplary embodiments.

With reference to FIG. 4, an exemplary burrowing device may include a silicone cover 420, which may cover the area where the anterior segment 110 and the posterior segment 120 meet. The silicone cover 420 allows the linear actuator to extend and contract freely while ensuring no particles of the granular medium enter the burrowing device. The exemplary burrowing device of FIG. 4 also includes a stationary conical tip coupled to the anterior segment. The burrowing device may also include a slot 410 to couple the posterior portion to a steel mast, which may fix the movement of the burrowing device on one or more planes for testing purposes. A pin can be entered in this slot and attached to an external mechanism to ensure movement along a certain axis if testing or the function desired of the burrowing device requires.

Figure 5:
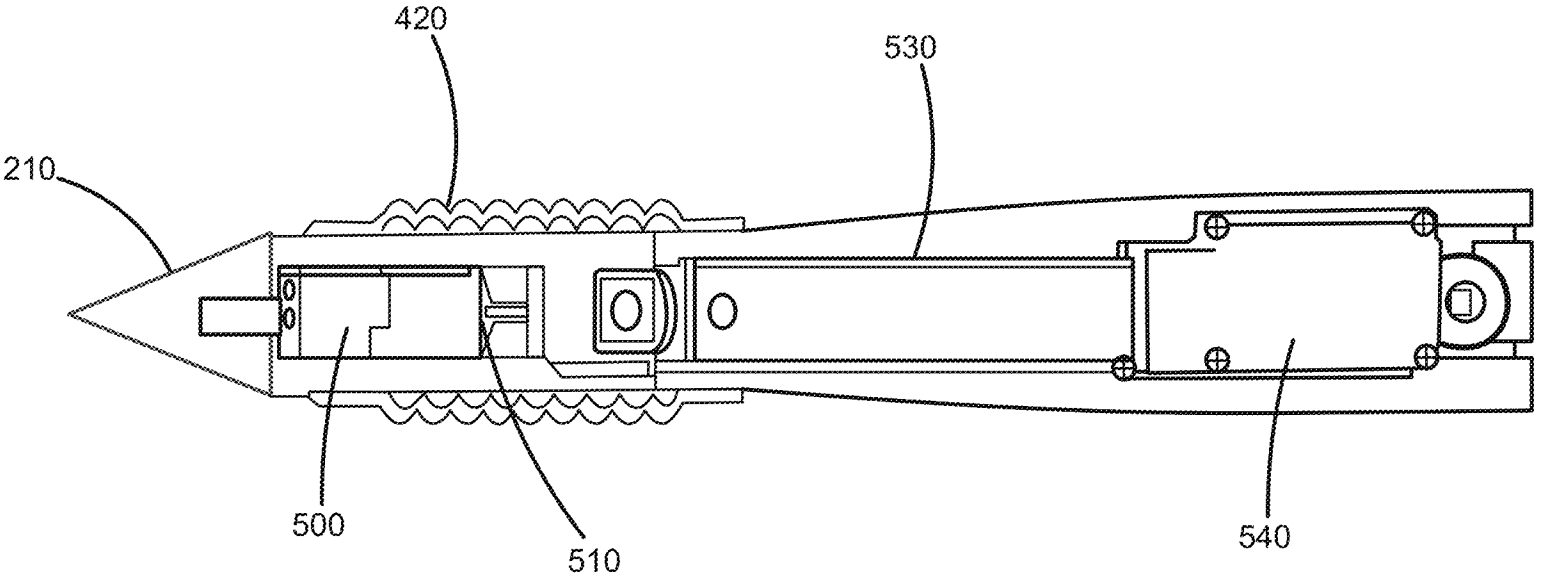
FIG. 5 illustrates an interior of a burrowing device, including a linear actuator placement, a micro linear actuator, an actuator casing, a gear motor, and a silicone cover for an anterior segment, in accordance with various exemplary embodiments.

With reference to FIG. 5, an exemplary burrowing device may also have a micro gear motor 500 coupled to the conical tip 210 and the anterior segment 110. The micro gear motor 500 allows the conical tip 210 to rotate by mechanically rotating a rotational element 510 that is coupled to the conical tip 210. The posterior segment 120 may house a linear actuator 540 which is within an actuator casing 530. The actuator casing is coupled to the anterior segment 110. When activated, the linear actuator 540 pushes and pulls the anterior segment 110 via its contact with the actuator casing 530, thereby extending and contracting the distance between anterior segment 110 and the posterior segment 120. The conical tip 210 may rotate when activated by the micro gear motor 500 when the linear actuator 540 is pushing the anterior segment 110 away from the posterior segment 120. In various embodiments, the anterior segment 110 and the area where the anterior segment 110 and the posterior segment meet is enclosed in a silicone cover 420. In various embodiments, this silicone cover 420 is made of Dragon-Skin-10 material. The silicone casing may be corrugated and soft to allow for expansion and contraction.

Figure 6:
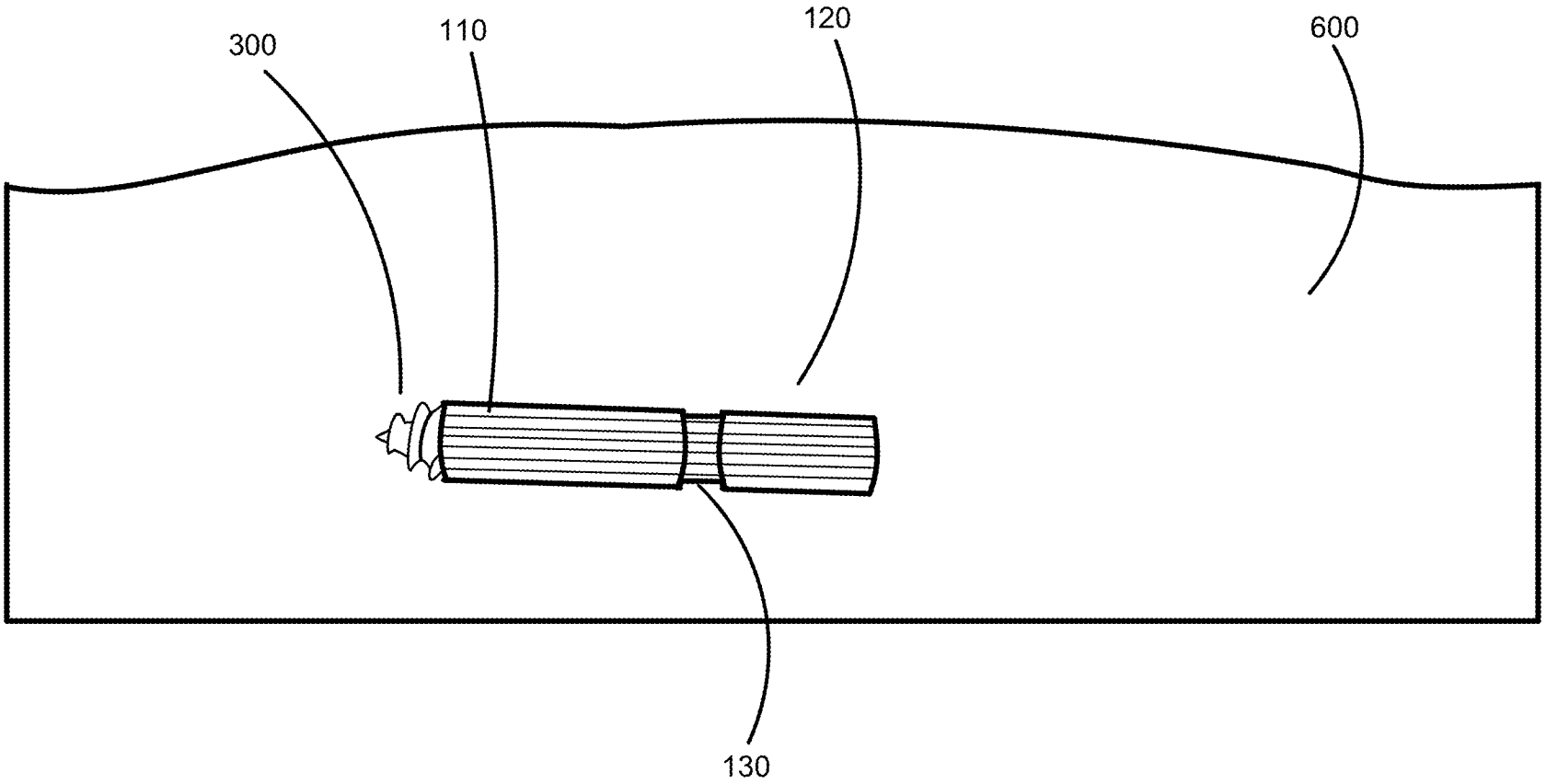
FIG. 6 illustrates a burrowing device in a granular medium, in accordance with various exemplary embodiments.

With reference to FIG. 6, an exemplary burrowing device comprises a threaded conical tip 300, an anterior segment 110, a posterior segment 120, and a coupling cylinder 130. The coupling cylinder is visible when the linear actuator is expanded to increase the distance between the anterior segment 110 and the posterior segment 120. The granular medium 600 surrounds the exemplary burrowing device and exerts forces on it that the mechanisms of the exemplary burrowing device overcomes to gain net horizontal displacement in the granular medium. An exemplary burrowing device is shown in FIG. 6 with the anterior segment 110 and threaded conical tip 300 slightly elevated in the granular medium 600 because of the upward forces of the granular medium 600 on the burrowing device 100.

Figure 7:
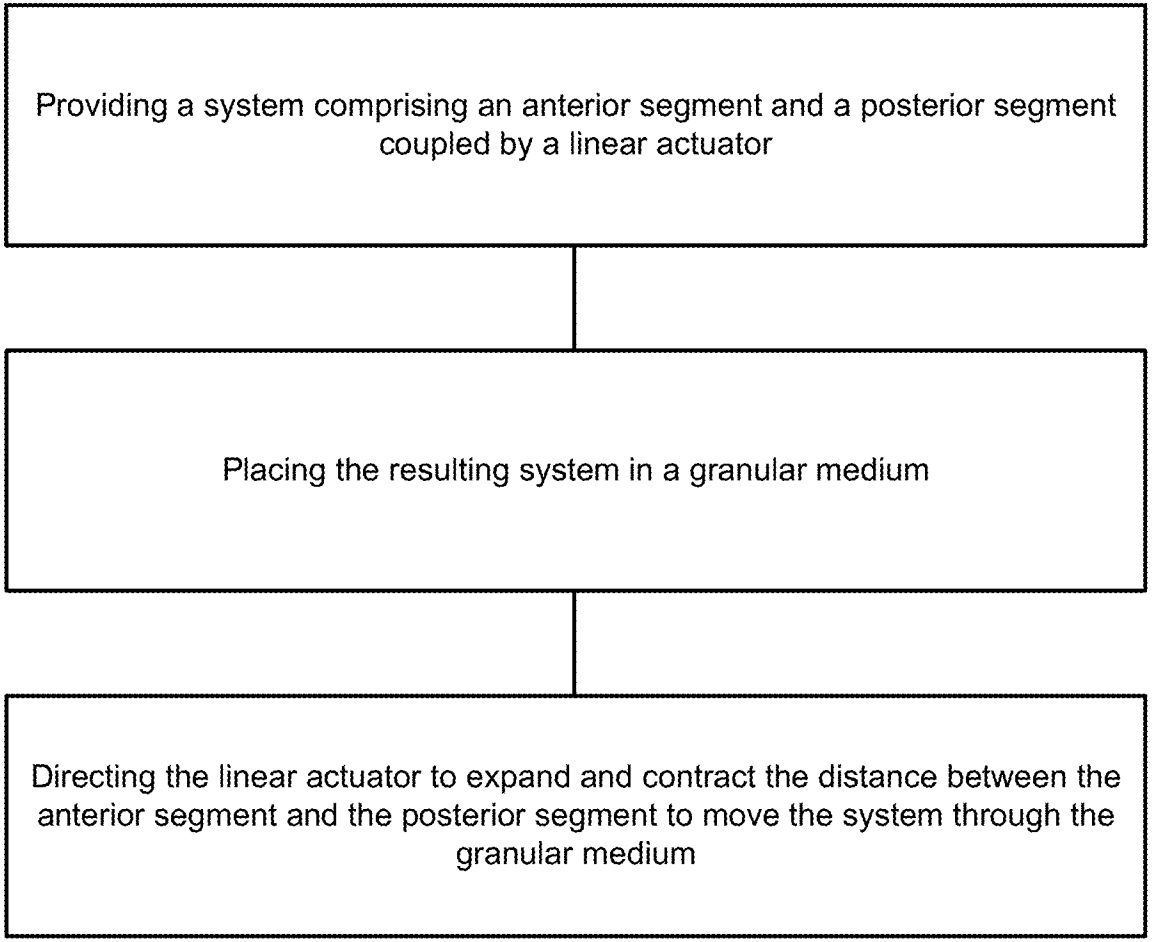
FIG. 7 illustrates a method of burrowing in a granular medium using a burrowing device with a linear actuator, in accordance with various exemplary embodiments.

With reference to FIG. 7, an exemplary method for burrowing horizontally in a granular medium is disclosed. The method includes coupling an anterior segment and a posterior segment together using a linear actuator, placing the resulting system in a granular medium, and directing the linear actuator to expand and contract the distance between the anterior segment and the posterior segment. The method may further comprise activating a micro gear motor to rotate the anterior segment when the linear actuator is pushing the anterior segment away from the posterior segment.

Also disclosed herein are methods and systems for testing burrowing devices to optimize the mechanical and dynamic properties of the burrowing device in various granular mediums. Potentially advantageous methodologies and designs of burrowing devices may also be derived experimentally, using various exemplary testing setups. Working examples and prophetic examples of burrowing devices are disclosed herein.

In various embodiments, determining the optimal burrowing mechanics may include physical testing of a burrowing device in a medium of glass beads, wherein the glass beads may be placed in a clear rectangular box. The clear rectangular box may have dimensions of 600 mm in length, 180 mm in width, and 300 mm in height. The burrowing device may be buried 7 cm below the surface. In various embodiments, the burrowing device may comprise an extensible body with a rotatable tip. In various embodiments, the burrowing device may be 33 mm in diameter, and may comprise two 3D printed sections (a posterior segment and an anterior segment) and a tip. The tip may be flat, conical, or conical with an auger (see FIG. 9A) The tip may further comprise a base that is a disk or square plate (see FIG. 9B) with a thickness of 11 mm. The burrowing device may comprise an anterior segment and a posterior segment, wherein the posterior segment contains a linear actuator, which is coupled to the anterior segment. The linear actuator may be an Actuonix L16-50-63-12-P. The anterior segment may contain a gear motor that is coupled to the tip. The linear actuator may extend and contract along the axial direction, and the gear motor may rotate at various speeds in various directions.

In various exemplary testing setups, a probe may be employed by inserting the probe into the posterior portion of the burrowing device when the burrowing device is in a granular medium. In various exemplary testing setups, the movement of the burrowing device may be measured using two vertical steel tubes, with a first vertical steel tube coupled to the anterior segment, and the second vertical steel tube coupled to the posterior segment. In various exemplary tests employing the testing setup, one or more burrowing scenarios may be tested by using different combinations of tip shapes and kinematic configurations. The tip shape may be a flat plate, a cone, and an auger, and kinematic configurations may include rotation and nonrotation of the tip. In various embodiments, the burrowing device employed in the testing setup may have a movement cycle of 5 seconds, wherein the linear actuator expands for 2 seconds, contracts for 2 seconds, and pauses for 1 second. When the kinematic configuration being tested is rotation of the tip, the rotational velocity may be 100 rpm in the counterclockwise direction, and may only rotate when the linear actuator is expanding.

Figure 8:
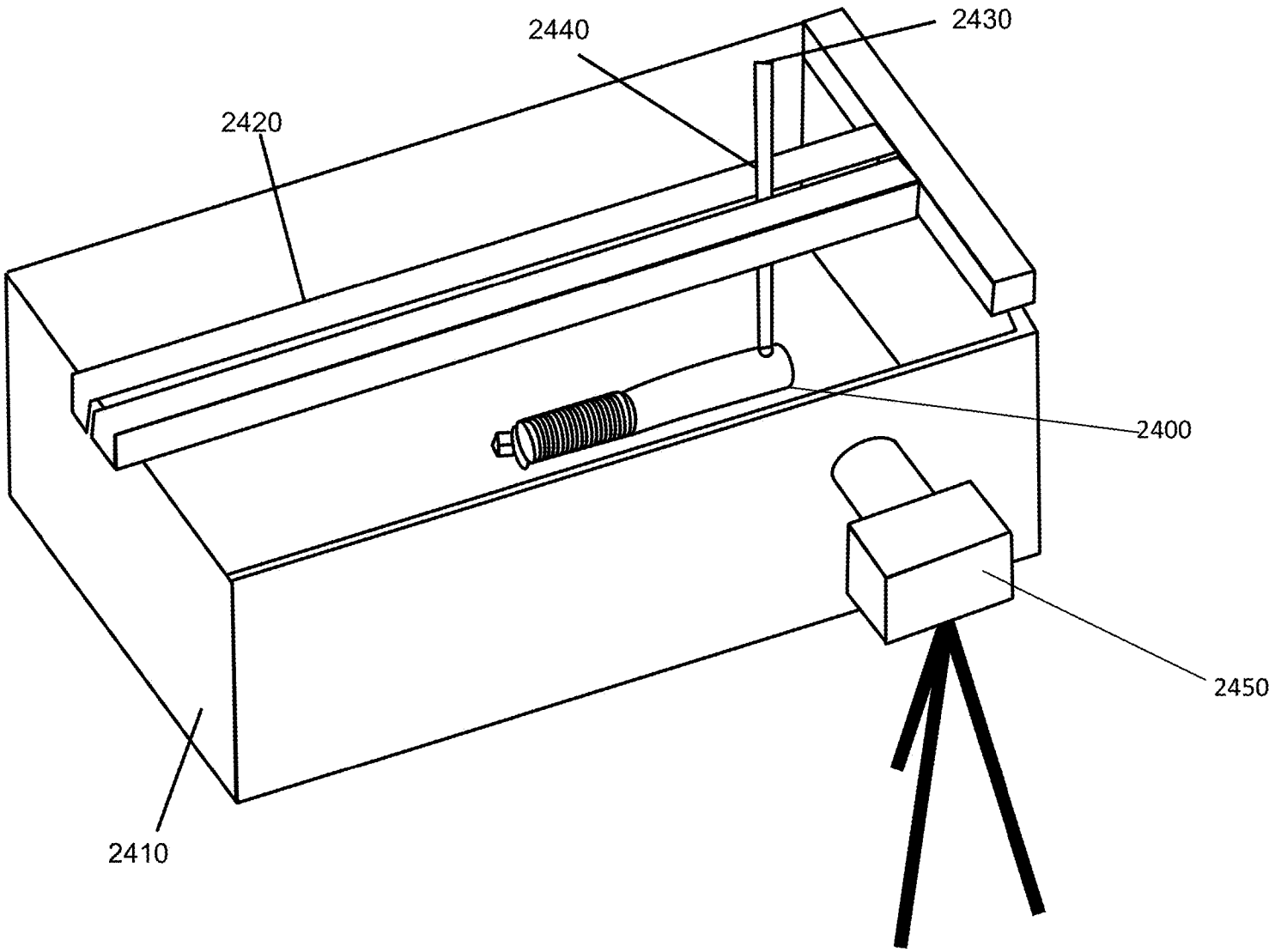
FIG. 8 shows the T-slot track setup for the physical testing of a burrowing device, wherein a mast coupled to the burrowing device allows visual data collection of the horizontal and vertical displacement of the burrowing device when it is burrowing, in accordance with various embodiments.

In various embodiments, referring to FIG. 8, experimentation of burrowing performance of a burrowing device may comprise filling a container 2410 with a granular medium, for example glass beads. In various embodiments of the testing setup, the container 2410 may comprise a T-slot framed track 2420 that is suspended above the container and aligned along the longitudinal direction of the container 2410. A burrowing device 2400 is buried in the granular medium, for example, at 7 cm below the surface wherein the longitudinal direction of the burrowing device 2400 is parallel to the sidewalls of the container 2410. The burrowing device 2400 may have a steel mast 2430 fixed to its posterior segment, and the steel mast 2430 may be perpendicular to the bottom of the container 2410. The steel mast 2430 may extend beyond the surface of the granular medium. In various embodiments, the steel mast 2430 may extend vertically beyond the T-slot framed track 2420, wherein the steel mast 2430 is within the T-slot of the T-slot framed track 2420. Various embodiments further comprise a second steel mast coupled to the anterior segment. Before the burrowing device 2400 begins moving, one or more markers 2430 may be made on the steel mast 2430 and one or more markers 2440 may be made on the T-slot framed track 2420 to indicate the starting point of the burrowing device. The horizontal and vertical displacement of the burrowing device 2400 may be determined by comparing the location of the steel mast 2430 in comparison to the markers 2440. The burrowing device may be activated and a high-resolution video may be taken of the movement of the steel mast 2430, wherein a camera 2450 is positioned in proximity to the T-slot framed track 2420. The videos may then be processed using a computer-vision library (for example OpenCV) and an optical flow algorithm (for example, based on the Lucas-Kanade method) to determine the trajectories of the two markers. Using these trajectories, burrowing characteristics for the burrowing device in the granular medium may be determined. This experimentation may be repeated using a combination of design elements on the burrowing device, wherein the data collected may indicate the most effective design elements.

Figure 9A:
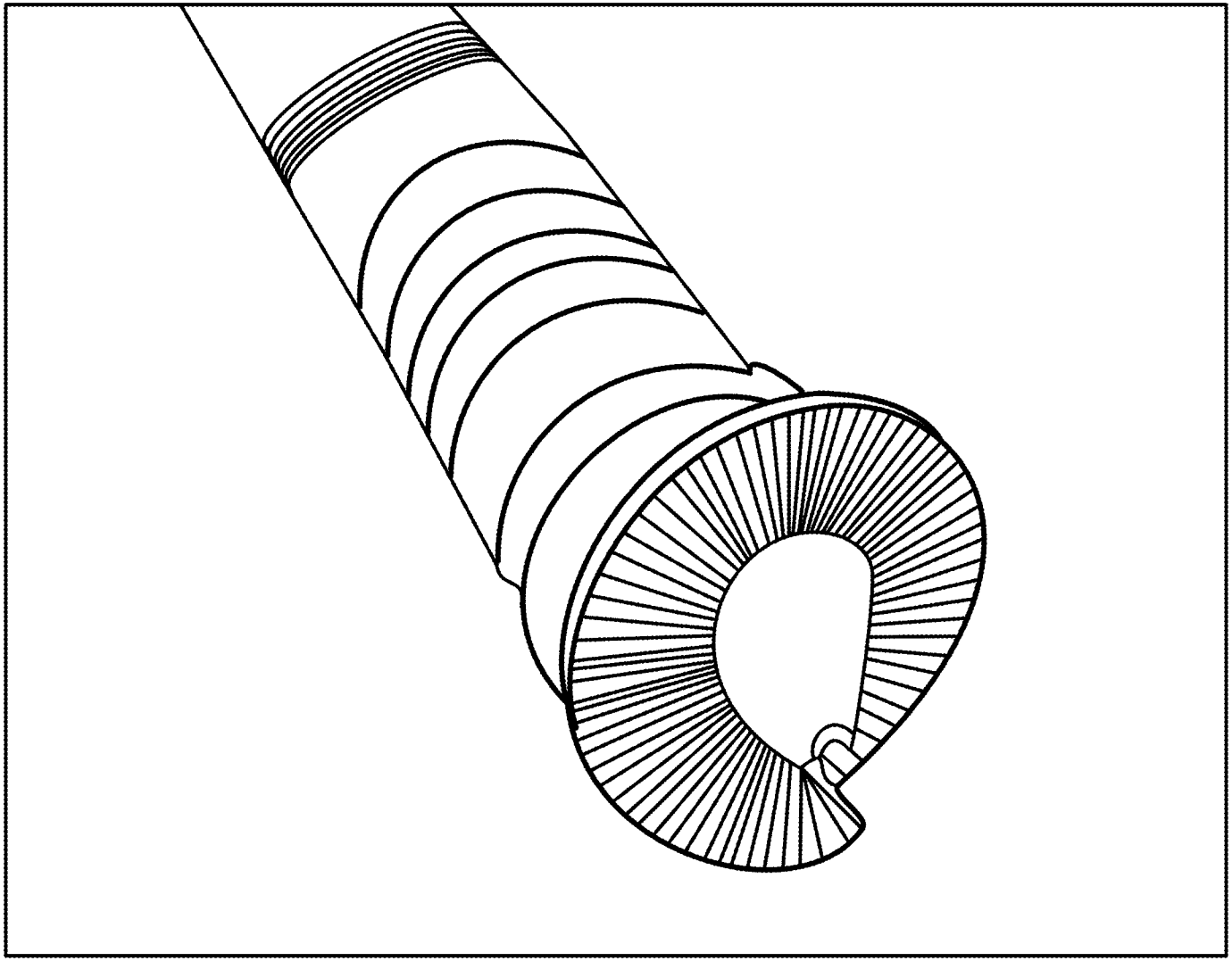
FIG. 9 shows a photographic image of the cross sections of various anterior tips of burrowing devices, wherein (a) is a round cross section, and (b) is a square cross section, in accordance with an exemplary embodiment.
Figure 9B:
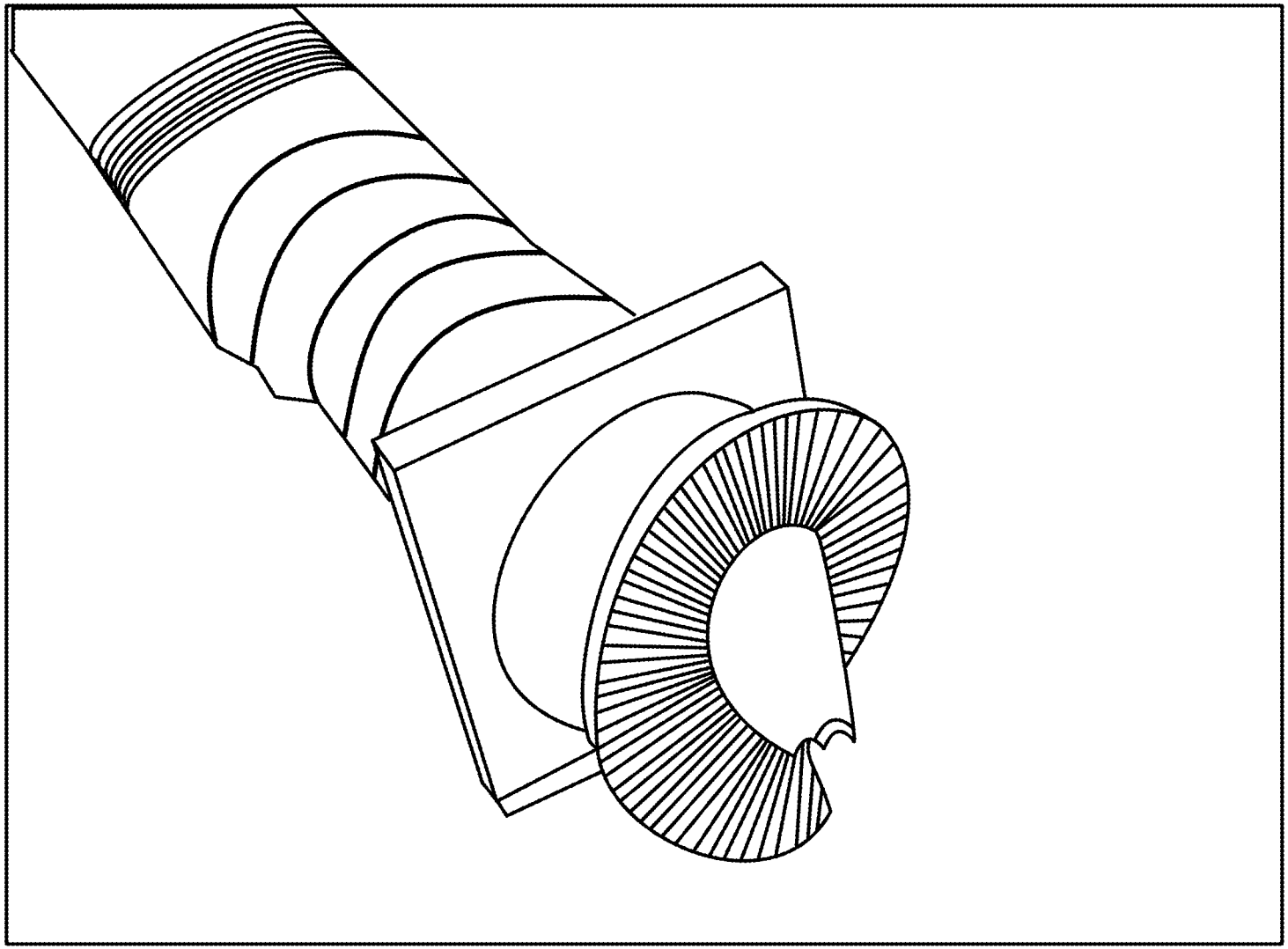

Two of the configurations are shown in FIGS. 9A and 9B, wherein (a) shows an anterior tip with a circular cross-section, and (b) shows an anterior tip with a square cross-section. The burrowing device may be tested with a number of different configurations, for example wherein: (1) the actuator extends at a fast rate, the tip rotates, the cross section is round, and there is no overburden pressure; (2) the actuator extends at a fast rate, the actuator contracts at a fast rate, the tip rotates, the cross section is round, and there is overburden pressure; (3) the actuator extends at a slow rate, the actuator contracts at a fast rate, the tip rotates, the cross section is round, and there is no overburden pressure; (4) the actuator extends at a fast rate, the actuator contracts at a fast rate, the tip does not rotate, the cross section is round, and there is no overburden pressure; and (5) the actuator extends at a fast rate, the actuator contracts at a fast rate, the tip does not rotate, there is a square cross section, and there is no overburden pressure. For each exemplary configuration of the burrowing device, the granular medium may comprise a constant number of particles with constant particle packing conditions. The overburden condition may be modified for testing by placing a metal plate on a local surface area above where the anterior segment is buried.

Figure 10A:
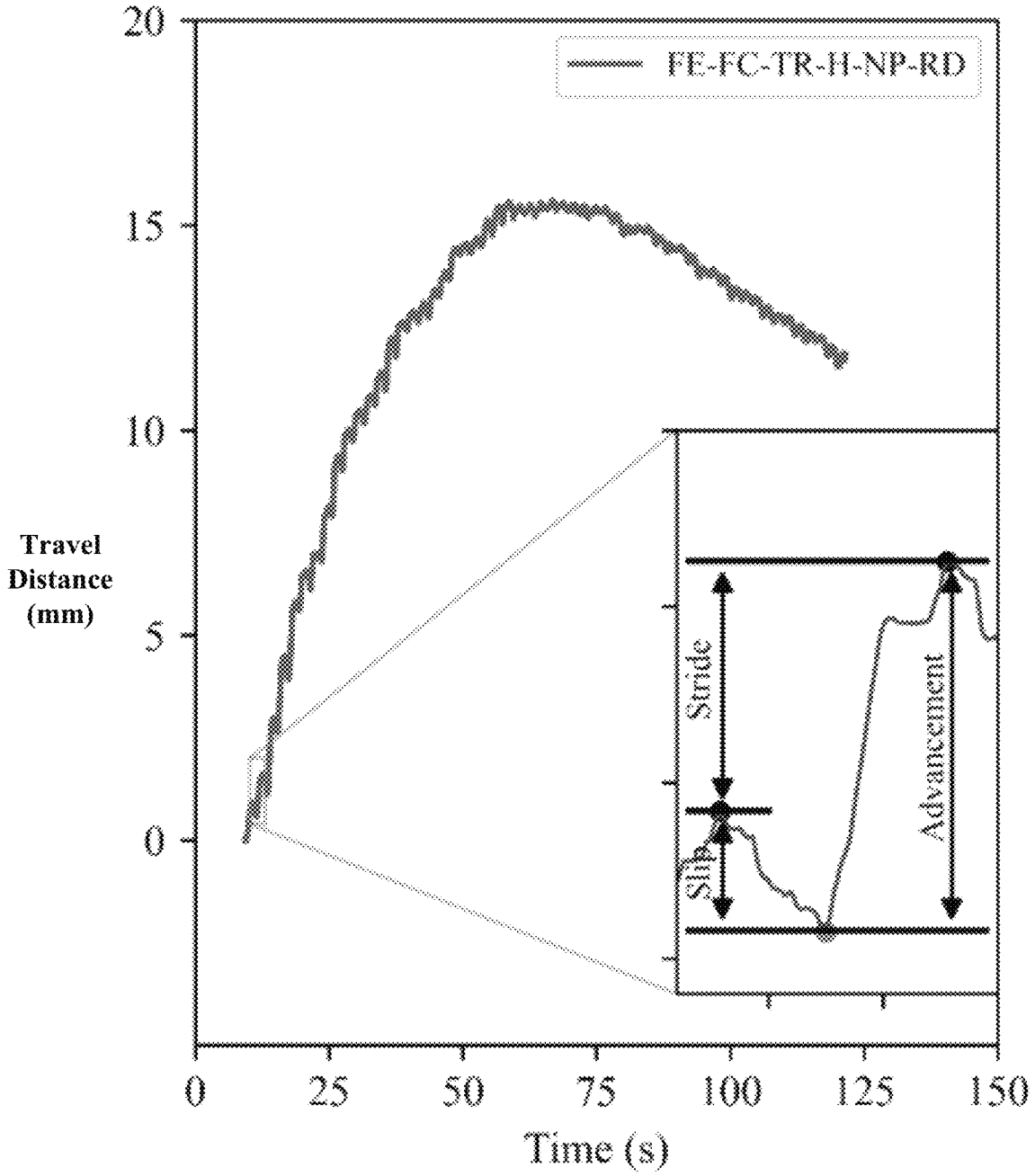
FIGS. 10A and 10B illustrate graphical representations of the horizontal displacement of the burrowing device as a function of time (FIG. 10A), and the inclination of the burrowing device as a function of time (FIG. 10B) when a T-slot track experiment is conducted, in accordance with an exemplary embodiment.
Figure 10B:
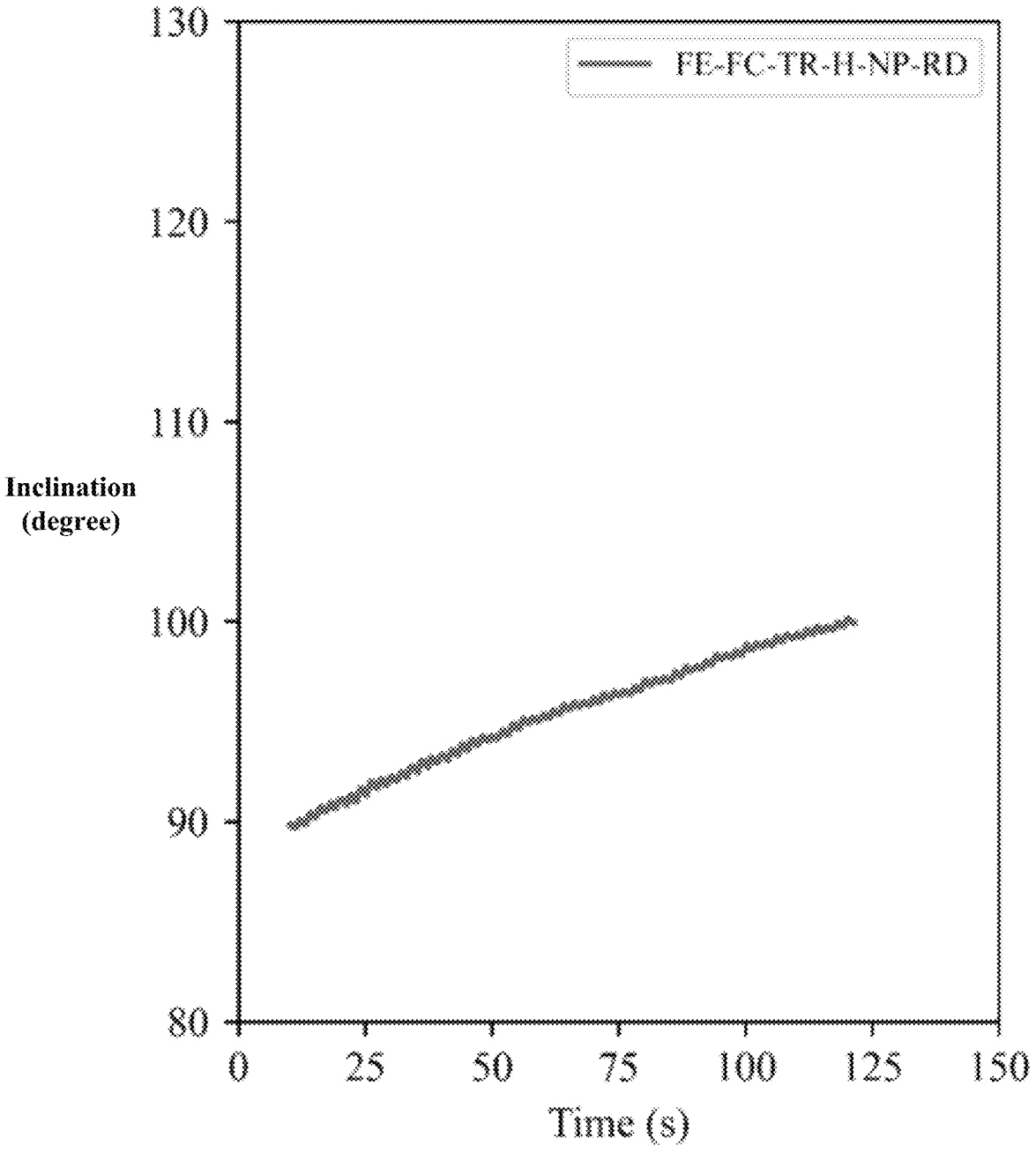

Referring to FIGS. 10A and 10B, an exemplary embodiment is measured during testing in an exemplary testing apparatus, wherein the markers are tracked, recorded and characterized to determine the inclination of the burrowing device and the horizontal displacement over the time of a testing segment, 125 seconds. In the exemplary test, the burrowing device moved horizontally during the first 70 seconds, then had significant slip for the rest of the testing segment. An increase in the inclination of the steel mast indicating an uplifting of the anterior tip was also observed (FIG. 10B).

Referring to FIGS. 10A, 10B, 11A, 11B, 12A, 12B, 13A, 13B, 14A, and 14B, the graphical representations of five different configurations are shown, wherein the graphed lines for each of the configurations are labeled according to the chart below:

| Test Label | Actuator extension | Actuator contraction | Tip rotation | Burrowing direction | Overburden pressure | Cross section |
|---|---|---|---|---|---|---|
| FE-FC-TR-H-NP-RD | Fast | Fast | Yes | Horizontal | Not applied | Round |
| FE-FC-TR-H-OP-RD | Fast | Fast | Yes | Horizontal | Applied | Round |
| SE-FC-TR-H-NP-RD | Slow | Fast | Yes | Horizontal | Not applied | Round |
| FE-FC-NR-H-NP-RD | Fast | Fast | No | Horizontal | Not applied | Round |
| FE-FC-NR-H-NP-RD | Fast | Fast | No | Horizontal | Not applied | Square |

For each test, the burrowing device with the configuration of interest is placed in the testing apparatus and activated. The movement of the linear actuator and gear motor may be controlled by a microcontroller, for example an Arduino Mega. In various embodiments, the resulting data recorded by measuring the horizontal displacement and vertical displacement for each configuration may be graphed. It is observed that for each extension and contraction cycle, the horizontal displacement decreases during the extension phase, and increases during the contraction phase. Wherein the steel mast tilt backwards or moves upward as the burrowing device moves forward, the vertical displacement of each of the anterior and posterior segments may be measured. It may be observed during the exemplary tests that inclination of the steel mast, or vertical displacement the steel mast, result in a reduction in the horizontal displacement of the burrowing robot.

Figure 11A:
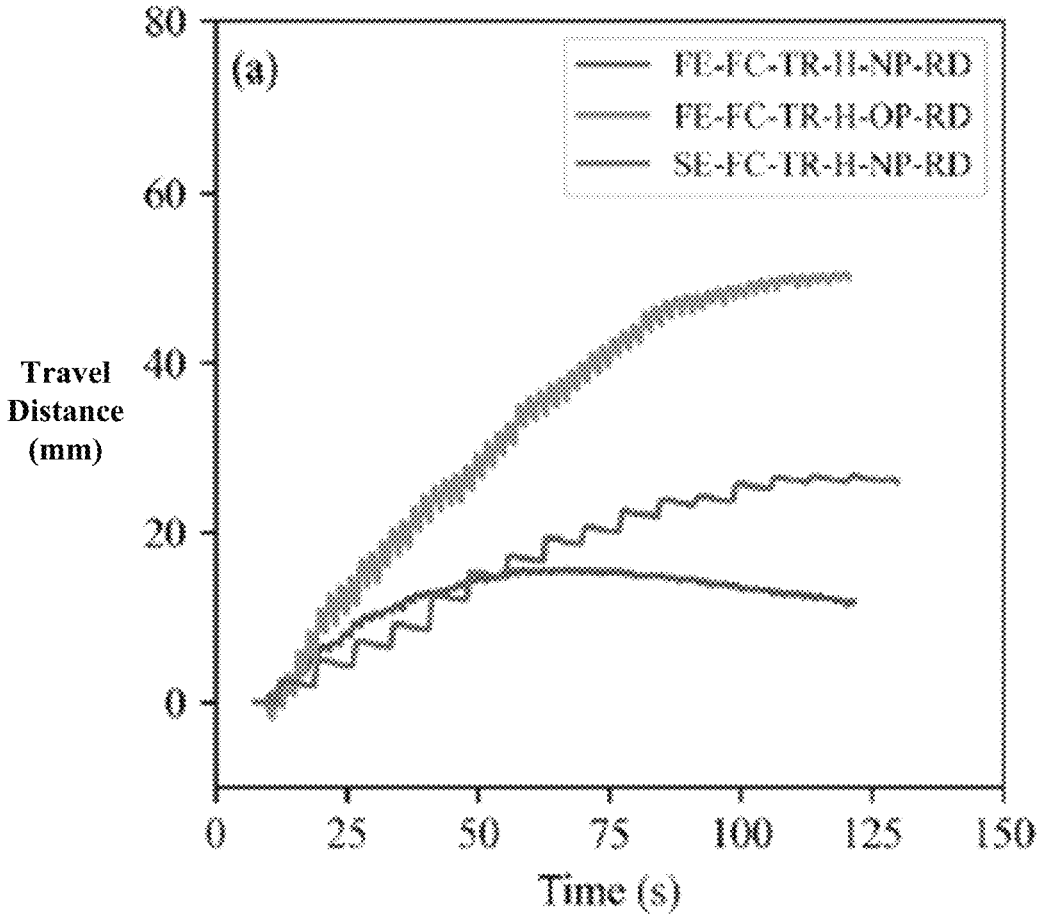
Figure 11B:
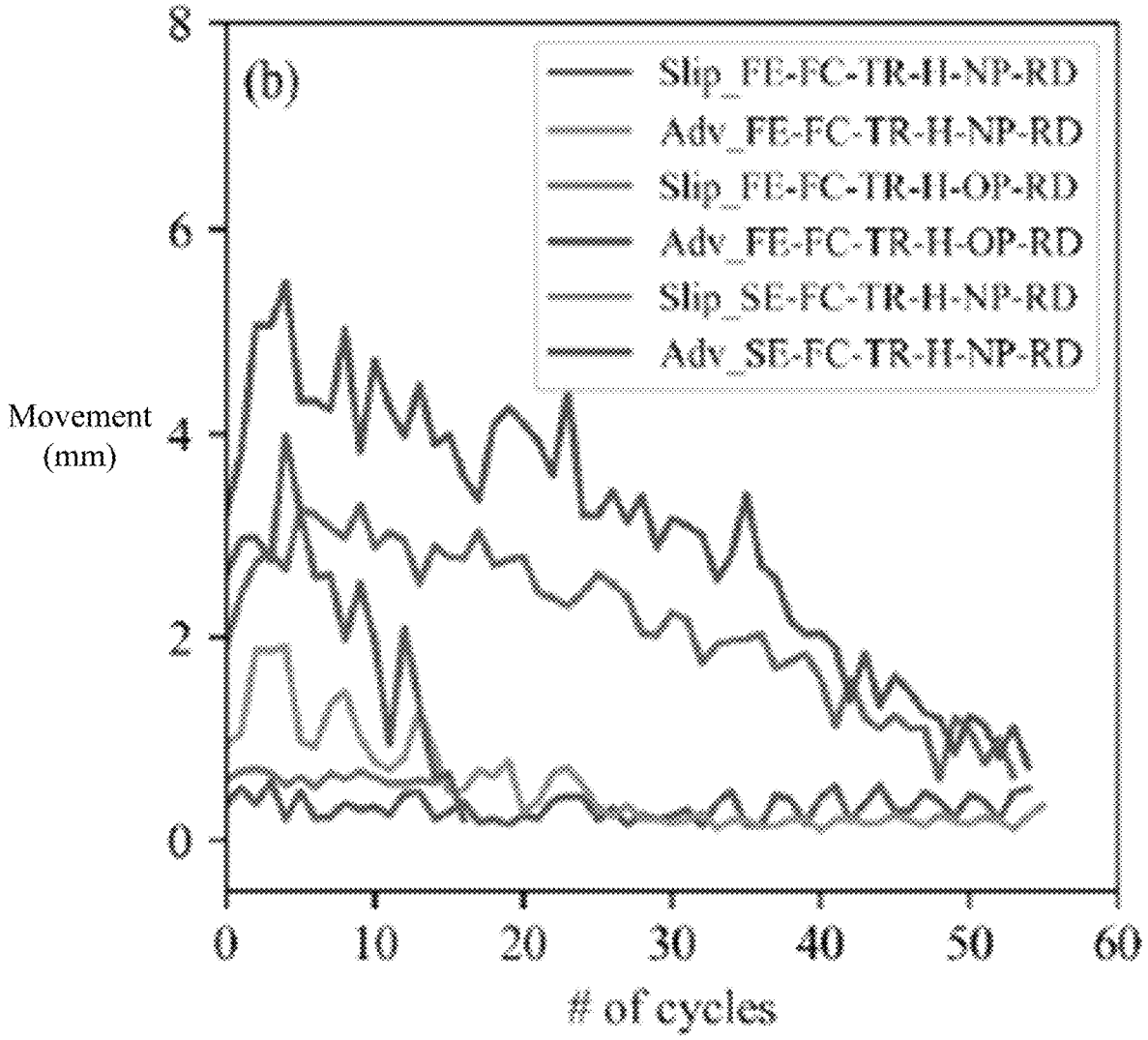
Figure 12A:
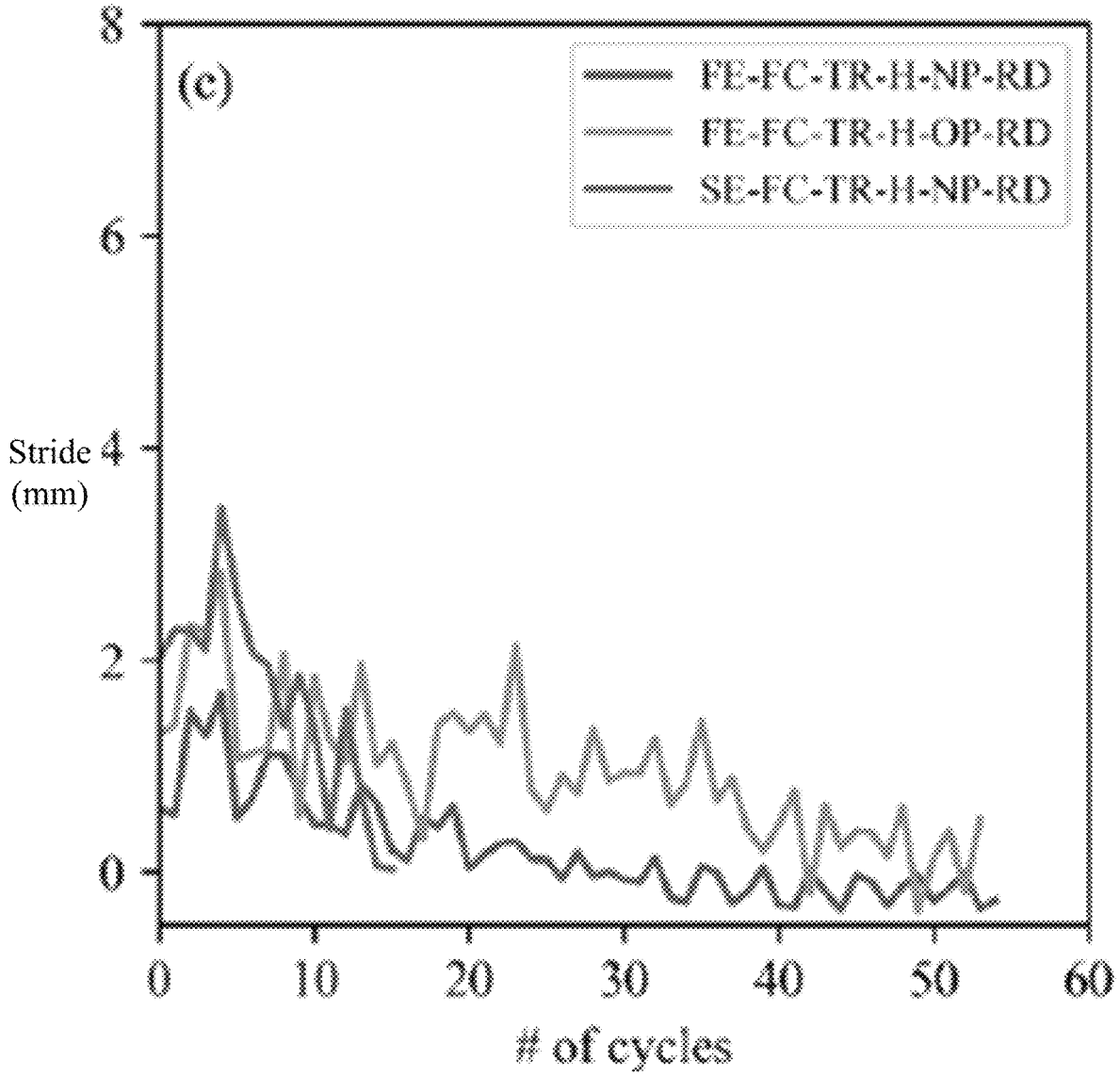
Figure 12B:
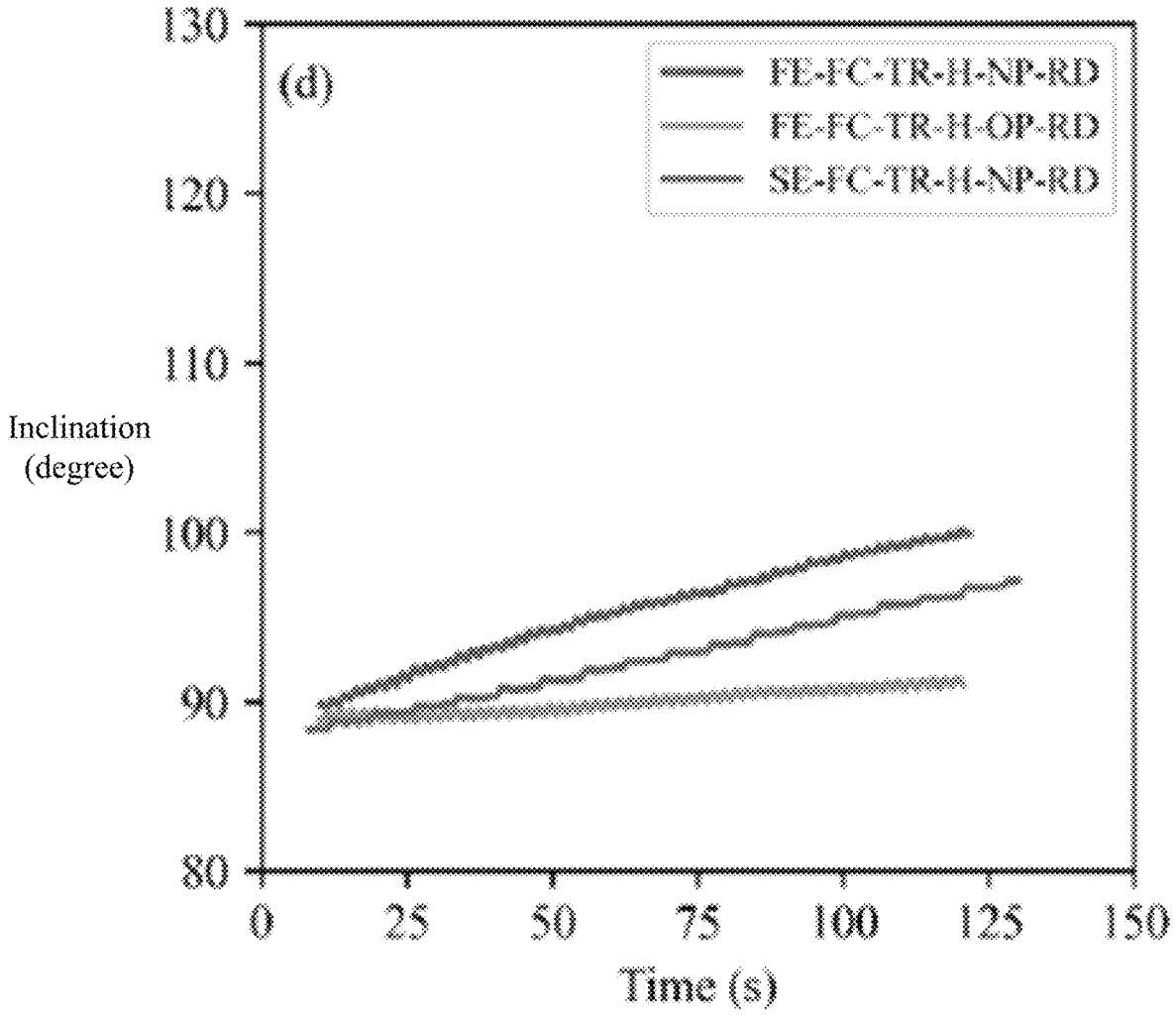

In various embodiments, testing using different configurations and analysis of the data may demonstrate a correlation between horizontal displacement and overburden pressure and extension rate for the tested medium. For example, in glass bead mediums, an exemplary embodiment showed that a slower extension rate and an increased overburden pressure increases the horizontal displacement and decreases the vertical displacement of the burrowing device. See FIG. 11A, showing the highest horizontal displacement for the configuration with overburden pressure. Also see FIG. 12B, showing the minimal inclination of the steel mast in the configuration where there is overburden pressure. Under these conditions, the horizontal displacement and the slip are increased, but the overall stride length increases (FIG. 12A). Referring to FIG. 11B, the horizontal displacement and slip of different configurations are mapped, showing the most horizontal displacement for the configuration wherein the actuator contracts at a fast rate, the tip rotates, the cross section is round, and there is overburden pressure. However, the slip of the same configuration is also significant. In various embodiments, the configurations with tip rotation and with a conical tip shape had the most horizontal displacement.

Figure 13A:
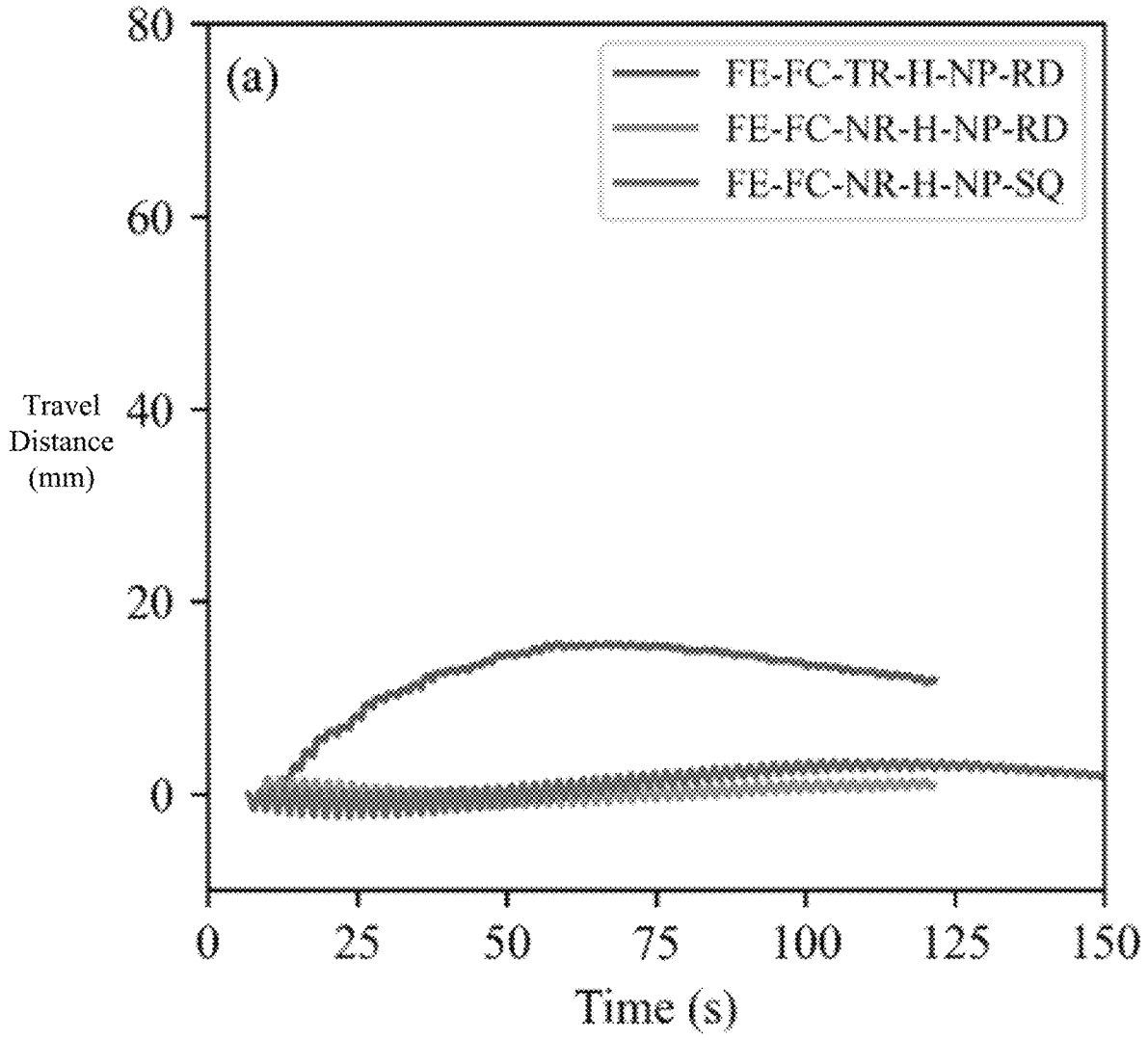
FIG. 13A illustrates the relationship between the horizontal displacement by the burrowing device and the time, for each of three different configurations with differing tip rotational velocities and cross-sectional shapes, in accordance with an exemplary embodiment.
Figure 13B:
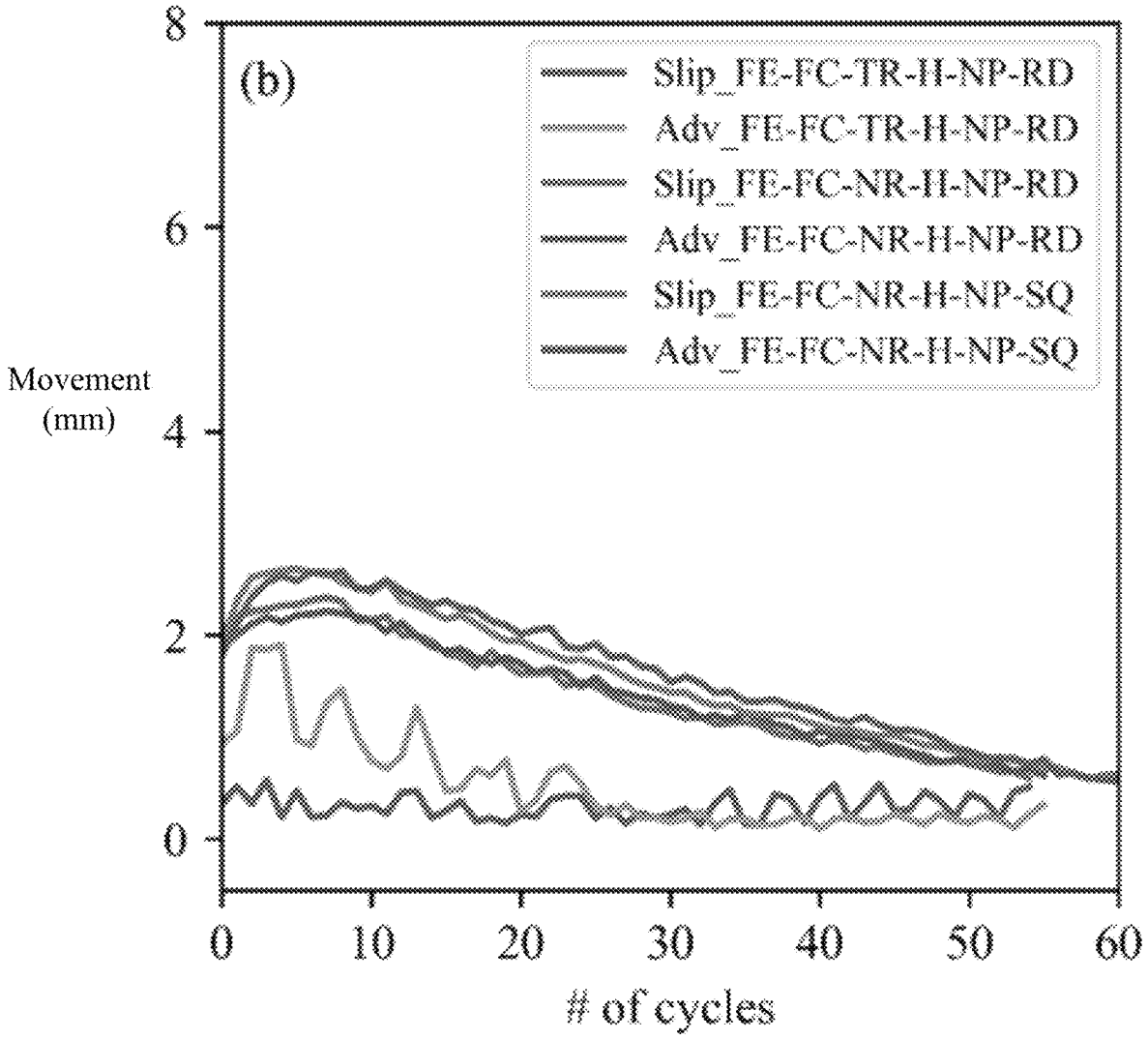
FIG. 13B illustrates the relationship between the horizontal displacement and slip distance in each extension-contraction cycle of the burrowing device and the number of extension-contraction cycles, for different configurations with differing tip rotational velocities and cross-sectional shapes, in accordance with an exemplary embodiment.
Figure 14A:
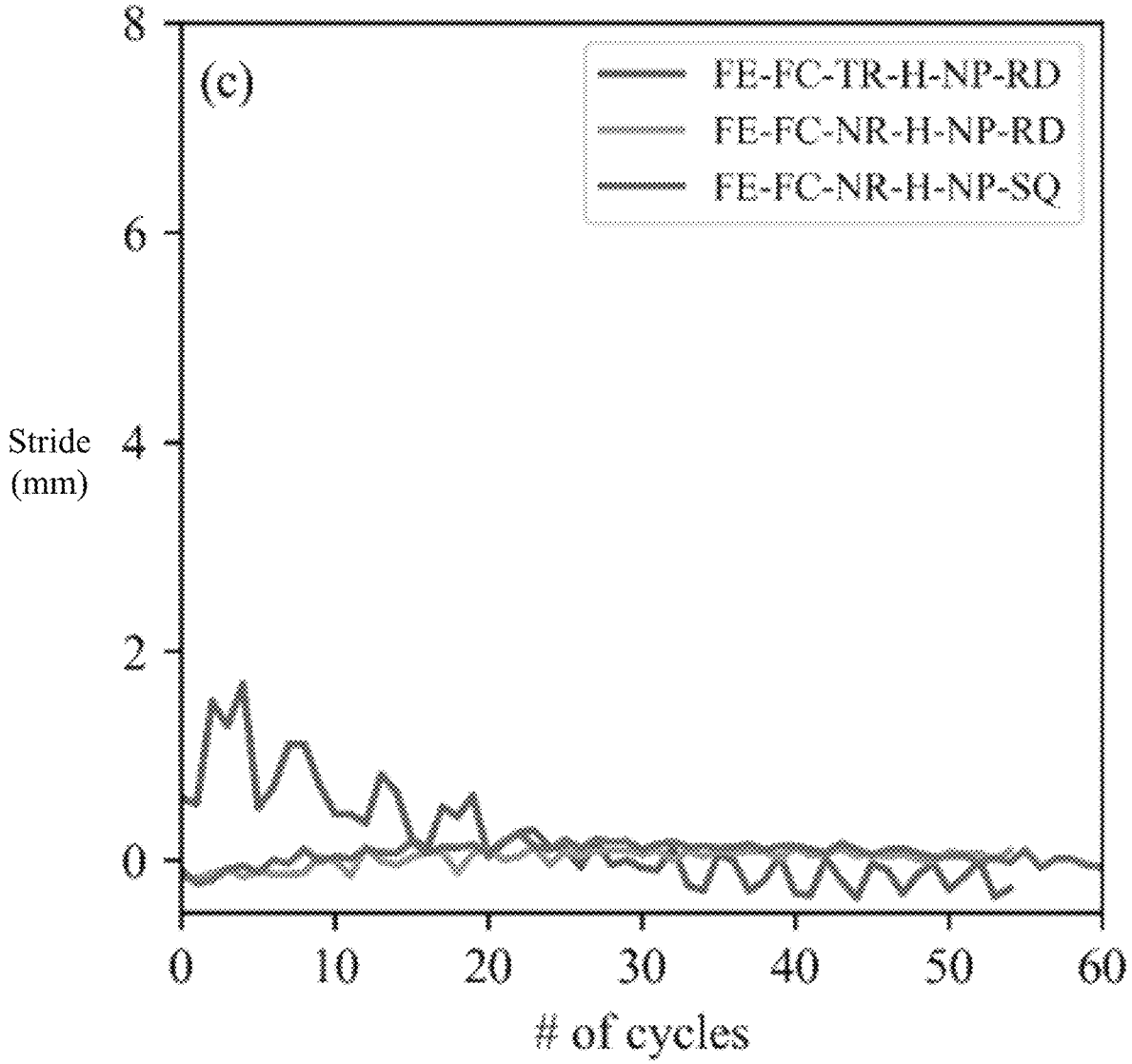
FIG. 14A illustrates the relationship between the stride length of the burrowing device and the number of extension-contraction cycles, for each of three different configurations with differing tip rotational velocities and cross-sectional shapes, in accordance with an exemplary embodiment.
Figure 14B:
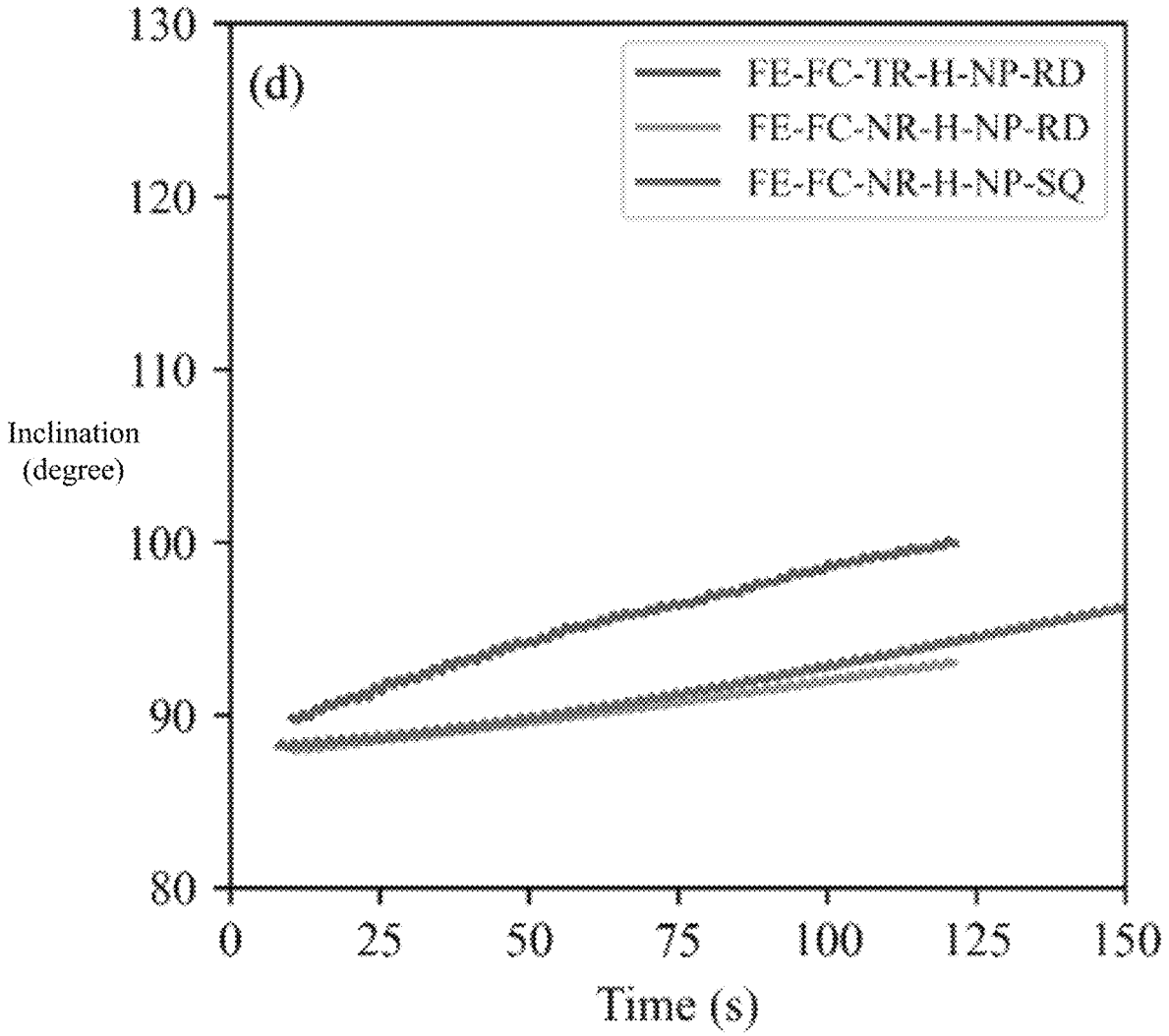
FIG. 14B illustrates the relationship between the inclination angle of the mast coupled to the burrowing device and time, for each of three different configurations with differing tip rotational velocities and cross-sectional shapes, in accordance with an exemplary embodiment.

Referring to FIGS. 13A, 13B, 14A and 14B, the impact of tip rotation and cross-sectional shape of the burrowing device is shown in an exemplary testing apparatus. In an exemplary embodiment of testing apparatus employing the T-slot, the configuration with rotation showed significantly more horizontal displacement than non-rotating configurations (FIG. 13A). The non-rotating configuration was comparable in horizontal displacement to the configuration with the square cross section. The configuration with tip rotation had a significantly longer stride length in its first ten extension and contraction cycles, but did not perform as well in later extension and contraction cycles (FIG. 14A). The configuration with tip rotation and a round cross-section also had the most inclination of the steel mast according to FIG. 14B.

Figure 15A:
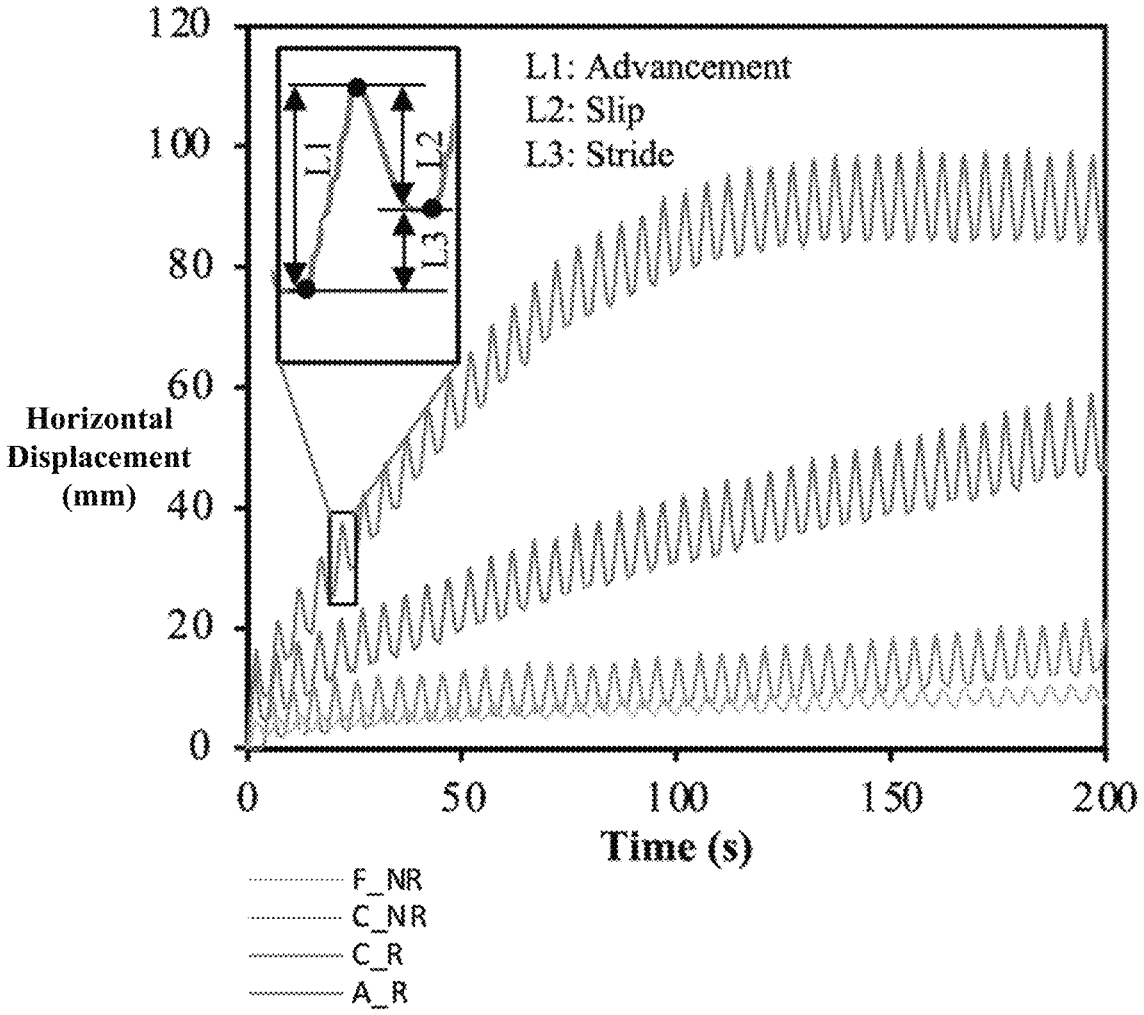
FIGS. 15A and 15B illustrate graphical representations based on tests run on an exemplary testing apparatus that employs a probe and two steel masts, showing the horizontal displacement (FIG. 15A) and vertical displacement (FIG. 15B) over time when an exemplary burrowing device is activated in a granular medium, in accordance with another exemplary embodiment.
Figure 15B:
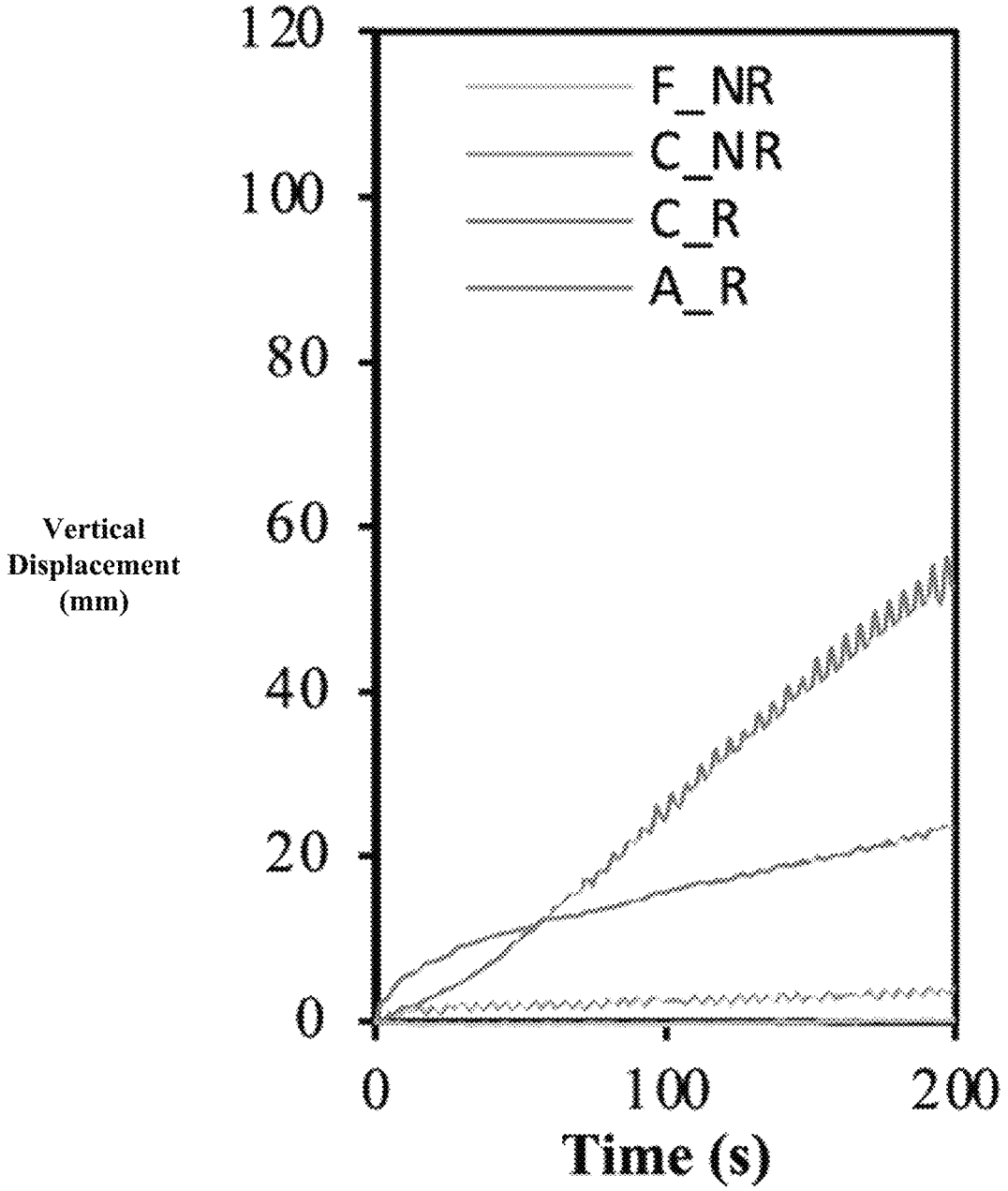

Referring to FIGS. 15A and 15B, another embodiment of a testing apparatus may comprise a first steel mast, which may be coupled to the anterior segment of the burrowing device, and a second steel mast, which may be coupled to the posterior segment of the burrowing device, and the horizontal and vertical displacement of the first steel mast and the second steel mast may be measured. Referring to FIG. 15A, the burrowing device may be operated and tested by measuring the displacement and relative position of the first steel mast and the second steel mast, wherein the advancement, slip, and stride may be measured. In various embodiments, the burrowing device may have a conical tip with auger and may rotate, wherein testing may show that the horizontal burrowing rate decreased gradually after 65 seconds as the robot tilted and moved closer to the surface and after 120 seconds the horizontal burrowing rate may be negligible. The burrowing robot may continue to tilt and move vertically until the tip burrowed out to the surface, as see in FIG. 15B. Referring to FIG. 15B, the vertical displacement for different configurations of a burrowing robot may be measured using the testing apparatus by measuring the length of each steel mast extending from the granular medium, wherein F_NR is a burrowing robot with a flat tip with no rotation, C_NR is a burrowing robot with a conical tip with no rotations, C_R is a burrowing robot with a conical tip with rotation, and A_R is a burrowing robot with an auger tip with rotation.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled." "coupling," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the specification or claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An apparatus for burrowing, comprising:

an anterior segment;

a posterior segment;

a coupling cylinder coupling the anterior segment to the posterior segment and having an outer diameter which is at least one of equivalent to or less than an inner diameter of the anterior segment;

a linear actuator disposed within the coupling cylinder and configured to expand and contract a distance between the anterior segment and the posterior segment by sliding the coupling cylinder into and out of the anterior segment; and a first conical tip coupled to the anterior segment.

2. The apparatus of claim 1, further comprising a gear motor coupled to the first conical tip and the anterior segment to rotate the first conical tip respective to the anterior segment.

3. The apparatus of claim 2, wherein the first conical tip further comprises threads.

4. The apparatus of claim 2, further comprising a micro gear motor coupled to the first conical tip and the anterior segment to enable the first conical tip to rotate.

5. The apparatus of claim 4, wherein the first conical tip is configured to rotate while the linear actuator extends the distance between the anterior segment and the posterior segment.

6. The apparatus of claim 1, wherein the anterior segment and the posterior segment are coupled by a flexible covering encasing the coupling cylinder.

7. The apparatus of claim 1, further comprising a second conical tip, wherein the second conical tip is coupled to the posterior segment.

8. The apparatus of claim 1, wherein the first conical tip rotates while the linear actuator extends the distance between the anterior segment and the posterior segment.

9. The apparatus of claim 8, wherein the first conical tip does not rotate while the linear actuator contracts the distance between the anterior segment and the posterior segment.

10. A device, comprising:

a first segment;

a second segment including a coupling cylinder having an outer diameter which is at least one of equivalent to or less than an inner diameter of the first segment; and a linear actuator coupled to the first segment and the second segment, wherein the linear actuator is configured to expand and contract the distance between the first segment and the second segment by sliding the coupling cylinder into and out of the first segment.

11. The device of claim 10, further comprising a conical tip coupled to the first segment.

12. The device of claim 11, wherein the conical tip is configured to rotate while the linear actuator expands the distance between the first segment and the second segment, and the linear actuator is configured to expand the distance between the first segment and the second segment at a faster velocity than it contracts the distance between the first segment and the second segment.

13. The device of claim 10, further comprising a silicone cover encasing the first segment and at least part of the second segment.

14. The device of claim 10, wherein a cross section of the second segment is square.

15. A method for burrowing in a granular medium, comprising:

providing a system comprising an anterior segment and a posterior segment coupled by a coupling cylinder having a linear actuator disposed therein;

placing the system in the granular medium; and directing the linear actuator to expand and contract the distance between the anterior segment and the posterior segment by sliding at least a portion of the coupling cylinder into and out of the anterior segment to move the system through the granular medium.

16. The method of claim 15, wherein the system further comprises a conical tip that is coupled to the anterior segment.

17. The method of claim 16, wherein the conical tip rotates when the linear actuator is expanding the distance between the anterior segment and the posterior segment.

18. The method of claim 16, wherein the conical tip comprises an auger.

19. The method of claim 18, further comprising rotating the conical tip while the linear actuator is expanding the distance between the anterior segment and the posterior segment.

20. The method of claim 19, wherein the linear actuator expands the distance between the anterior segment and the posterior segment at a greater velocity than the linear actuator contracts the distance between the anterior segment and the posterior segment.

* * * * *